US010443414B2

(12) United States Patent
Yokoyama et al.

(10) Patent No.: US 10,443,414 B2
(45) Date of Patent: Oct. 15, 2019

(54) TURBINE CASING, TURBINE, CORE FOR CASTING TURBINE CASING, AND METHOD FOR PRODUCING TURBINE CASING

(71) Applicant: MITSUBISHI HEAVY INDUSTRIES ENGINE & TURBOCHARGER, LTD., Sagamihara-shi, Kanagawa (JP)

(72) Inventors: Takao Yokoyama, Tokyo (JP); Yoji Akiyama, Tokyo (JP)

(73) Assignee: MITSUBISHI HEAVY INDUSTRIES ENGINE & TURBOCHARGER, LTD., Sagamihara-Shi (JP)

( * ) Notice: Subject to any disclaimer, the term of this patent is extended or adjusted under 35 U.S.C. 154(b) by 343 days.

(21) Appl. No.: 15/311,788

(22) PCT Filed: Jul. 3, 2014

(86) PCT No.: PCT/JP2014/067760
§ 371 (c)(1),
(2) Date: Nov. 16, 2016

(87) PCT Pub. No.: WO2016/002039
PCT Pub. Date: Jan. 7, 2016

(65) Prior Publication Data

US 2018/0223679 A1 Aug. 9, 2018

(51) Int. Cl.
*F01D 9/02* (2006.01)
*F02B 39/00* (2006.01)
(Continued)

(52) U.S. Cl.
CPC ..... *F01D 9/026* (2013.01); *B22C 9/10* (2013.01); *F01D 25/24* (2013.01); *F02B 39/00* (2013.01);
(Continued)

(58) Field of Classification Search
CPC ... F01D 9/026; B22C 9/10; B22C 9/22; F02B 39/00; F02B 37/025; F05D 2220/40; F03B 11/02; F04D 29/44; F04D 29/54
See application file for complete search history.

(56) References Cited

U.S. PATENT DOCUMENTS 4,027,994 A * 6/1977 MacInnes ..... F01D 9/026 415/1
4,512,714 A * 4/1985 Kaesser ..... F01D 17/146 415/151
(Continued)

FOREIGN PATENT DOCUMENTS

DE 40 08 508 A1 9/1990
JP 61-40418 A 2/1986
(Continued)

OTHER PUBLICATIONS

International Search Report for PCT/JP2014/067760 dated Sep. 2, 2014.
(Continued)

*Primary Examiner* — Dwayne J White
*Assistant Examiner* — Jackson N Gillenwaters
(74) *Attorney, Agent, or Firm* — Birch, Stewart, Kolasch & Birch, LLP

(57) ABSTRACT

A turbine casing includes: a shroud of a cylindrical shape defining an operational flow path between the shroud and a hub of a turbine rotor; a scroll outer peripheral wall continuing from an end side of the shroud and extending along a circumferential direction of the shroud; and a partition wall disposed inside the scroll outer peripheral wall and dividing an inside of the scroll outer peripheral wall into a first scroll flow path and a second scroll flow path disposed adjacent to each other in an axial direction of the shroud. The shroud, the scroll outer peripheral wall, and the partition wall are formed integrally by casting. The partition wall has a
(Continued)

widening section which partially increases a communication area between at least two of the first scroll flow path, the second scroll flow path, and the operational flow path, in the circumferential direction of the shroud.

6 Claims, 17 Drawing Sheets

(51) Int. Cl.
*F01D 25/24* (2006.01)
*B22C 9/10* (2006.01)
*F02B 37/02* (2006.01)

(52) U.S. Cl.
CPC ..... *F02B 37/025* (2013.01); *F05D 2220/40* (2013.01); *F05D 2230/21* (2013.01); *F05D 2240/14* (2013.01)

(56) References Cited

U.S. PATENT DOCUMENTS

| | | | | |
|---|---|---|---|---|
| 4,565,068 | A * | 1/1986 | Schneider | F01D 17/146 415/205 |
| 4,719,757 | A | 1/1988 | Nakazawa et al. | |
| 4,794,758 | A | 1/1989 | Nakazawa et al. | |
| 5,094,587 | A * | 3/1992 | Woollenweber | F01D 9/026 415/205 |
| 8,813,820 | B1 * | 8/2014 | Chang | B22C 9/082 164/339 |
| 9,206,732 | B2 * | 12/2015 | Cattani | F01D 9/026 |
| 2003/0053910 | A1 | 3/2003 | Hosny | |
| 2013/0121820 | A1 * | 5/2013 | Yoshida | F01D 9/026 415/205 |

FOREIGN PATENT DOCUMENTS

| | | | |
|---|---|---|---|
| JP | 61-122305 | U | 8/1986 |
| JP | 61-207829 | A | 9/1986 |
| JP | 62-3863 | A | 1/1987 |
| JP | 62-228627 | A | 10/1987 |
| JP | 63-40535 | A | 2/1988 |
| JP | 63-88221 | A | 4/1988 |
| JP | 4-81523 | A | 3/1992 |
| JP | 8-303201 | A | 11/1996 |
| JP | 11-303642 | A | 11/1999 |
| JP | 2003-35152 | A | 2/2003 |
| JP | 2005-503508 | A | 2/2005 |
| JP | 2008-303849 | A | 12/2008 |
| KR | 10-1365021 | B1 | 3/2014 |

OTHER PUBLICATIONS

Osako et al., "Development of Twinscroll Turbine for Automotive Turbochargers using Unsteady Numerical Simulation", Mitsubishi Heavy Industries Technical Review, Mar. 2013, vol. 50, No. 1, total 16 pages.
Written Opinion of the International Searching Authority for PCT/JP2014/067760 (PCT/ISA/237) dated Sep. 2, 2014.
Extended European Search Report effective May 12, 2017 issued in the corresponding EP Application No. 14896471.1.
International Preliminary Report on Patentability effective Jan. 12, 2017, issued to International Application No. PCT/JP2014/067760 with an English Translation.
Office Action effective Jul. 5, 2018 issued to the corresponding EP Application No. 14896471.1.
Chinese Office Action effective May 17, 2018 issued to the corresponding Chinese Application No. 201480079195.1.
Japanese Notification of Reasons for Refusal for Japanese Application No. 2016-530756, dated Jun. 23, 2017, with a Machine translation.
Office Action effective Mar. 4, 2019, issued in the corresponding EP Application No. 14896471.1.

* cited by examiner

TURBINE CASING, TURBINE, CORE FOR CASTING TURBINE CASING, AND METHOD FOR PRODUCING TURBINE CASING

TECHNICAL FIELD

The present disclosure relates to a turbine casing, a turbine, a core for casting a turbine casing, and a method for producing a turbine casing.

BACKGROUND ART

Patent Document 1 discloses a turbocharger of twin-scroll type to be applied to a multi-cylinder and high-displacement engine for a ship or the like. Such a turbocharger has a turbine casing including a shroud that defines an operational flow path between a hub of a turbine rotor and the shroud, a scroll outer peripheral wall continuing from one end side of the shroud and extending along the circumferential direction of the shroud, and a partition wall disposed inside the scroll outer peripheral wall and dividing the inside space of the scroll outer peripheral wall into the first scroll flow path and the second scroll flow path disposed adjacent to each other in the axial direction of the shroud.

The scroll outer peripheral wall has a tongue section at the most downstream position thereof. The partition wall extends up to the position of 200 degrees in the circumferential direction of the shroud, where the position in the circumferential direction of the shroud is represented with reference to the position of the tongue section as the zero-degree position, and the flowing direction of the fluid as the positive direction. Further, a coating layer is formed on an inner wall of a downstream region (a region from 200 to 360 degrees in the circumferential direction of the shroud) where the partition wall is not provided. According to the document, the above configuration effectively suppresses occurrence of erosion due to collision of particles in a fluid (exhaust gas) in the downstream region without the partition wall.

Patent Document 2 discloses a turbine casing including three cast components: a turbine-side component, an intermediate component, and an exhaust-side component. The turbine-side component, the intermediate component, and the exhaust-side component are welded at butting surfaces and integrated into one piece. The turbine-side component forms the shroud and a part of the scroll outer peripheral wall, while the intermediate component forms another part of the scroll outer peripheral wall and the partition wall. The exhaust-side component forms the remaining part of the scroll outer peripheral wall. According to the document, such a turbine casing has a small thickness and a small weight, as well as a smooth-surfaced flow path that carries a fluid (exhaust gas).

CITATION LIST

Patent Literature

Patent Document 1: JPH11-303642A
Patent Document 2: JP2003-35152A

SUMMARY

Problems to be Solved

Meanwhile, automotive manufacturers have been downsizing automobiles by using turbochargers to cut fuel consumption by the engines. Turbochargers are now mounted to low-displacement engines as well, and are required to be reduced in size. Turbine casings are also to be reduced in size in accordance, but maintaining the same shape before and after downsizing may lead to a decrease in the communication area between an operational flow path and the first scroll flow path, as well as in the communication area between the operational flow path and the second scroll flow path. Also, in this case, the first scroll flow path and the second scroll flow path are in communication in the vicinity of the operational flow path, and thus the communication area between the first scroll flow path and the second scroll flow path also decreases.

If the communication areas between the first scroll flow path, the second scroll flow path, and the operational flow path are reduced as described above, it is difficult to produce a turbine casing by casting. That is, while a core is required to cast a turbine casing, reduced communication areas would decrease the thickness of parts of the core that form communicating sections between the first scroll flow path, the second scroll flow path, and the operational flow path, thus reducing the strength of the parts of the core, which may lead to breakage of the core during casting.

In this connection, Patent Document 1 does not disclose casting a turbine casing.

Patent Document 2 discloses casting a turbine-side component, an intermediate component, and an exhaust-side component separately, but welding the turbine-side component, the intermediate component, and the exhaust-side component at the butting surfaces is a complicated work, and increases the production time of a turbine casing.

In view of the above issues, an object of at least one embodiment of the present invention is to provide a turbine casing, a turbine provided with the turbine casing, a core for casting the turbine casing, and a method of producing the turbine casing, whereby it is possible to enhance the strength of the core for casting the turbine casing.

Solution to the Problems (1) A turbine casing according to at least one embodiment of the present invention comprises: a shroud of a cylindrical shape defining an operational flow path between the shroud and a hub of a turbine rotor; a scroll outer peripheral wall continuing from an end side of the shroud and extending along a circumferential direction of the shroud; and a partition wall disposed inside the scroll outer peripheral wall and dividing an inside of the scroll outer peripheral wall into a first scroll flow path and a second scroll flow path disposed adjacent to each other in an axial direction of the shroud. The shroud, the scroll outer peripheral wall, and the partition wall are formed integrally by casting. The partition wall includes a widening section which partially increases a communication area between at least two of the first scroll flow path, the second scroll flow path, and the operational flow path, in the circumferential direction of the shroud.

With the above configuration (1), the shroud, the scroll outer peripheral wall and the partition wall are integrally formed by casting, and thereby the turbine casing can be produced readily.

Furthermore, with the above configuration (1), the turbine casing includes the widening section that widens the communication area between at least two of the first scroll flow path, the second scroll flow path, and the operational flow path, and thus the thickness of the core increases at the part corresponding to the widening section. As a result, it is possible to enhance the strength of the core for casting the turbine casing.

(2) In some embodiments, in the above configuration (1), the widening section includes at least one cutout portion provided for an inner peripheral side of the partition wall. With the above configuration (2), the communication area between the first scroll flow path and the second scroll flow path is increased at the cutout portion disposed in the partition wall, and the thickness of the core increases at the part corresponding to the cutout portion. As a result, it is possible to enhance the strength of the core for casting the turbine casing.

(3) In some embodiments, in the above configuration (2), the scroll outer peripheral wall includes a tongue section at a most downstream position of the first scroll flow path and the second scroll flow path in a flow direction of a fluid. The at least one cutout portion includes a downstream cutout portion extending downstream in the flow direction of the fluid from a position of at least 90 and no more than 270 degrees in the circumferential direction of the shroud, where a position in the circumferential direction of the shroud is represented with reference to a position of the tongue section as a zero-degree position and the flow direction of the fluid as a positive direction.

With the above configuration (3), the communication area between the first scroll flow path and the second scroll flow path is increased at the downstream cutout portion of the partition wall, and the thickness of the core increases at the part corresponding to the downstream cutout portion. As a result, it is possible to enhance the strength of the core for casting the turbine casing.

Furthermore, the flow rate of the fluid is smaller at the downstream side than at the upstream side of the first scroll flow path and the second scroll flow path. Thus, with the downstream cutout portion provided as the cutout portion, it is possible to suppress change in the flow velocity or the pressure of the fluid.

(4) In some embodiments, in the above configuration (2), the at least one cutout portion includes a plurality of cutout portions disposed rotationally symmetric with respect to an axis of the shroud.

With the above configuration (4), the communication area between the first scroll flow path and the second scroll flow path is increased at the plurality of cutout portions disposed rotationally symmetric about the axis of the shroud, and the thickness of the core increases at the parts corresponding to the plurality of cutout portions. As a result, it is possible to enhance the strength of the core for casting the turbine casing.

(5) In some embodiments, in the above configuration (3), the scroll outer peripheral wall has such a shape that A/R of a flow path combining the first scroll flow path and the second scroll flow path in a region where the downstream cutout portion is formed is smaller than an A/R distribution in a case where a total of A/R of the first scroll flow path and the second scroll flow path at an upstream side of the downstream cutout portion linearly decreases toward 360 degrees.

With the downstream cutout portion provided, the first scroll flow path and the second scroll flow path merge in the flow region that has the downstream cutout portion. Thus, if the cutout portion is simply provided, the flow channel widens in the flow region with the downstream cutout portion for a fluid flowing through the first scroll flow path and the second scroll flow path, which may change the velocity and the pressure of the fluid.

With the above configuration (5), however, A/R of the first scroll flow path and the second scroll flow path combined in a flow region where the downstream cutout portion is formed is smaller than the A/R distribution in a case where the total A/R of the first scroll flow path and the second scroll flow path at the upstream side of the downstream cutout portion linearly decreases toward 360 degrees, and thereby an increase in the flow-path area is suppressed in the flow region with the downstream cutout portion, which suppresses change in the flow velocity and the pressure of the fluid.

(6) In some embodiments, in the above configuration (1), the widening section comprises at least one through hole disposed on the partition wall.

With the above configuration (6), the first scroll flow path and the second scroll flow path are in communication with each other via the through hole disposed on the partition wall, and a part of the core corresponding to the first scroll flow path and a part of the core corresponding to the second scroll flow path are connected at a part of the core corresponding to the through hole. As a result, it is possible to enhance the strength of the core for casting the turbine casing.

(7) In some embodiments, in the above configuration (6), the partition wall includes a rectifying portion disposed around the at least one through hole.

With the above configuration (7), the flow of a fluid flowing about the through hole is rectified, and thereby it is possible to reduce a leak flow between the first scroll flow path and the second scroll flow path.

(8) In some embodiments, in the above configuration (1), the widening section includes at least one bend portion provided for an inner peripheral side of the partition wall.

With the above configuration (8), the bend portion disposed on the inner peripheral side of the partition wall increases the communication area between the first scroll flow path and the operational flow path, or between the second scroll flow path and the operational flow path. In this case, the thickness of the core increases at the core joint section connecting a part of the core corresponding to the first scroll flow path and a part of the core corresponding to the operational flow path, or at the core joint section connecting a part of the core corresponding to the second scroll flow path and a part of the core corresponding to the operational flow path. As a result, it is possible to enhance the strength of the core for casting the turbine casing.

(9) In some embodiments, in the above configuration (8), the at least one bend portion includes: at least one first bend portion widening a throat portion of the first scroll flow path facing the operational flow path; and at least one second bend portion widening a throat portion of the second scroll flow path facing the operational flow path.

With the above configuration (9), the first bend portion increases the thickness of a part of the core corresponding to the throat portion of the first scroll flow path, while the second bend portion increases the thickness of a part of the core corresponding to the throat portion of the second scroll flow path. Accordingly, the thickness of the core increases at both of the core joint section connecting a part of the core corresponding to the first scroll flow path and a part of the core corresponding to the operational flow path, and the core joint section connecting a part of the core corresponding to the second scroll flow path and a part of the core corresponding to the operational flow path. As a result, it is possible to enhance the strength of the core for casting the turbine casing.

(10) A turbine according to at least one embodiment of the present invention comprises the turbine casing according to any one of the above (1) to (9).

With the above configuration (10), even if the turbine casing is small, the turbine casing can be produced readily by casting. Thus, it is possible to provide a downsized turbine at low cost and with high productivity.

(11) A core, according to at least one embodiment of the present invention, is for casting a turbine casing which comprises: a shroud of a cylindrical shape defining an operational flow path between the shroud and a hub of a turbine rotor; a scroll outer peripheral wall continuing from an end side of the shroud and extending along a circumferential direction of the shroud; and a partition wall disposed inside the scroll outer peripheral wall and dividing an inside of the scroll outer peripheral wall into a first scroll flow path and a second scroll flow path disposed adjacent to each other in an axial direction of the shroud. The shroud, the scroll outer peripheral wall, and the partition wall are formed integrally. The partition wall includes a widening section which partially increases a communication area between at least two of the first scroll flow path, the second scroll flow path, and the operational flow path, in the circumferential direction of the shroud. The core comprises: a shroud forming portion for defining a runner corresponding to the shroud; a scroll-outer-peripheral-wall forming portion for defining a runner corresponding to the scroll outer peripheral wall; a partition-wall forming portion for defining a runner corresponding to the partition wall; and a reinforcement portion disposed on a section of a runner corresponding to the widening section.

With the above configuration (11), the thickness of the core increases at the reinforcement portion, and it is possible to enhance the strength of the core for casting the turbine casing.

(12) In some embodiments, in the above configuration (11), the reinforcement portion includes at least one narrow-space filling portion disposed in a narrow space on an inner peripheral side of the partition-wall forming portion.

With the above configuration (12), the thickness of the core increases at the narrow-space filling portion, and it is possible to enhance the strength of the core for casting the turbine casing.

(13) In some embodiments, in the above configuration (11), the reinforcement portion includes at least one column portion disposed in a runner corresponding to the partition wall.

With the above configuration (13), two regions of the scroll outer-peripheral-wall forming portion divided by the partition-wall forming portion are connected via the column portion. As a result, it is possible to enhance the strength of the core for casting the turbine casing.

(14) In some embodiments, in the above configuration (11), the reinforcement portion includes at least one thick portion displacing an inner peripheral side of the partition wall in an axial direction of the shroud.

With the above configuration (14), the thickness of the core increases at the thick portion, and it is possible to enhance the strength of the core for casting the turbine casing.

A turbine casing according to at least one embodiment of the present invention is casted by using the core for casting the turbine casing according to any one of the above (11) to (14).

With the above configuration, even if the turbine casing is small, the turbine casing can be produced readily by casting.

(15) A method of producing a turbine casing according to at least one embodiment of the present invention comprises: a step of providing the core for casting a turbine casing according to any one of the above (11) to (14); and a step of casting the turbine casing by using the prepared core.

According to the above method (16), even if the turbine casing is small, the turbine casing can be produced readily by casting. Thus, it is possible to provide a downsized turbine at low cost and with high productivity.

Advantageous Effects

According to at least one embodiment of the present invention, provided is a turbine casing which enhances the strength of a core for casting the turbine casing.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "center", "centered", "on the same axis" and "coaxial" shall not be construed as indicating only the arrangement in a strict literal sense, but also includes a state where the arrangement is relatively displaced by a tolerance, or by an angle or a distance whereby it is possible to achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
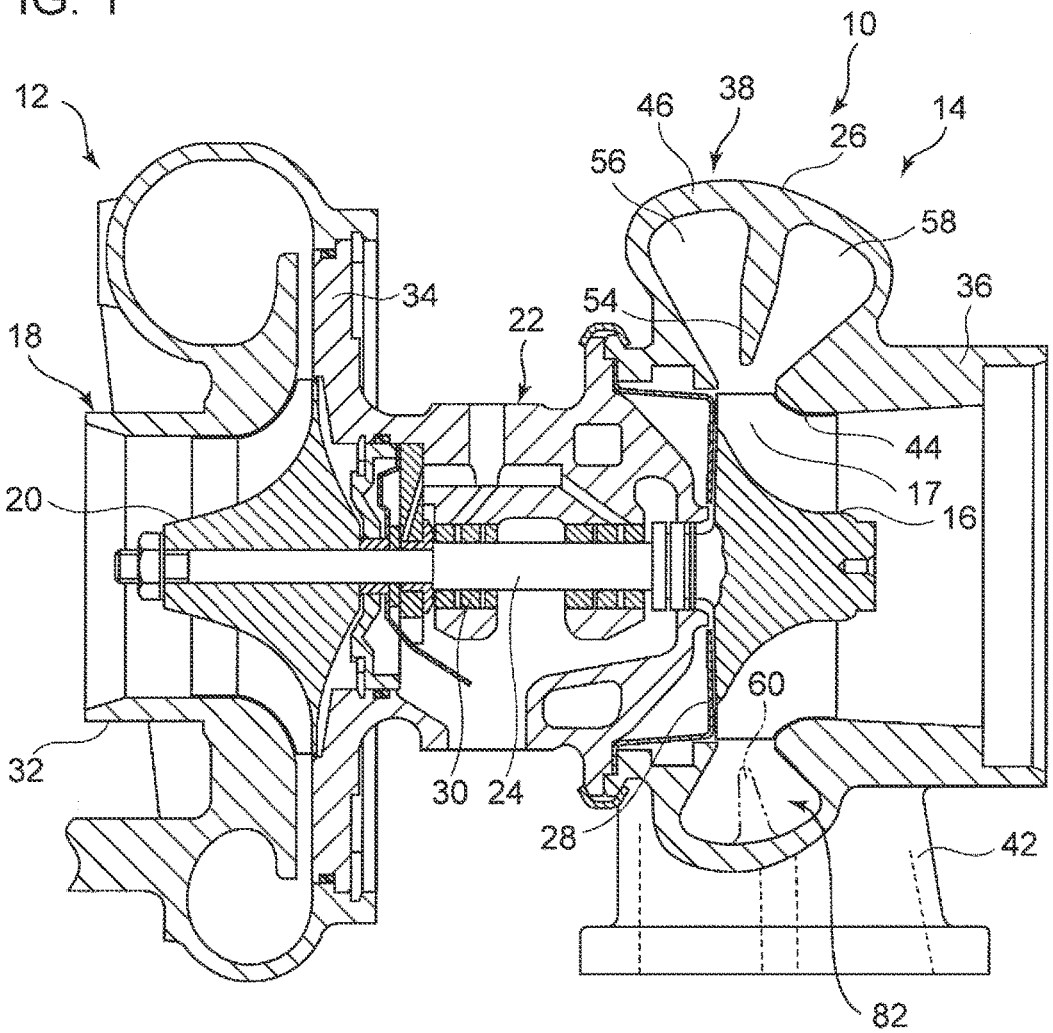
FIG. 1 is a vertical cross-sectional view schematically showing a turbocharger according to an embodiment of the present invention.
Figure 2:
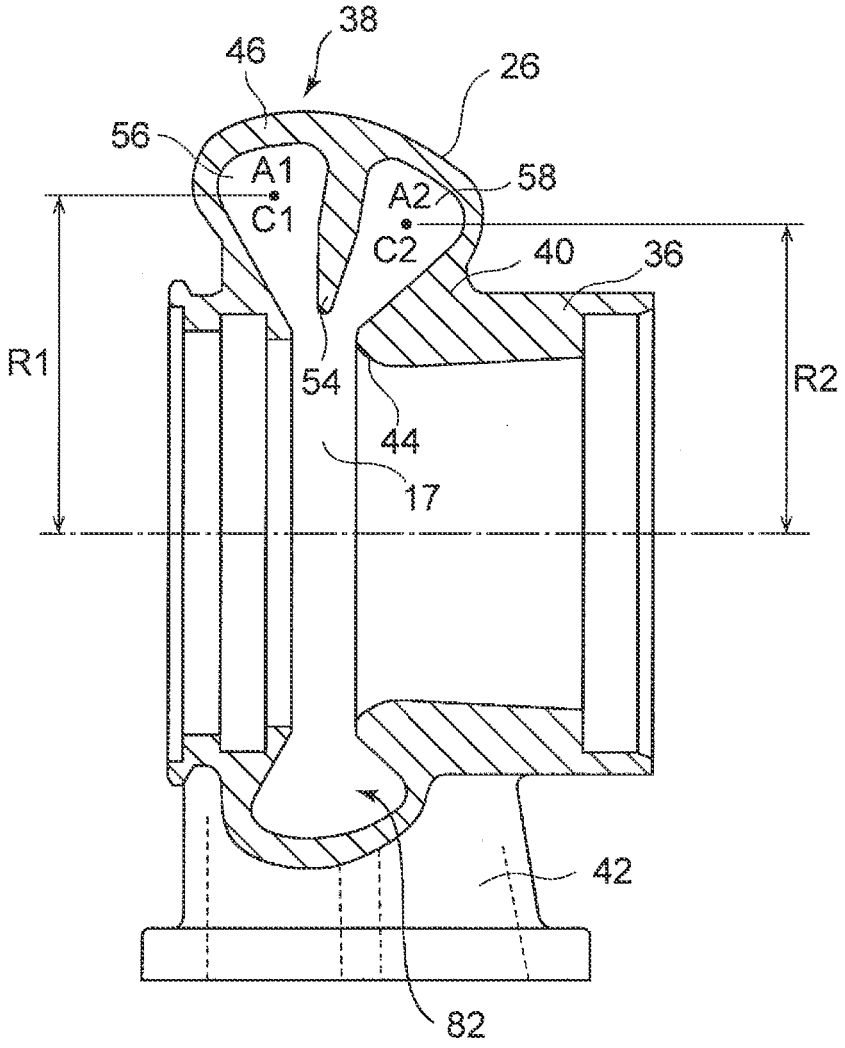
FIG. 2 is a schematic cross-sectional view of the turbine casing in FIG. 1.

FIG. 1 is a vertical cross-sectional view schematically showing a turbocharger according to some embodiments of the present invention. FIG. 2 is a schematic cross-sectional view of the turbine casing in FIG. 1. A turbocharger is, for instance, applied to an internal combustion engine of a vehicle or the like.

The turbocharger includes a turbine 10 and a compressor 12. The turbine 10 includes a turbine housing 14, a turbine rotor (turbine impeller) 16 accommodated rotatably inside the turbine housing 14, while the compressor 12 includes a compressor housing 18 and an impeller (compressor impeller) 20 accommodated rotatably in the compressor housing 18.

The turbine housing 14 and the compressor housing 18 are fixed to a bearing housing (casing) 22, and the turbine rotor 16 of the turbine 10 and the impeller 20 of the compressor 12 are coupled to each other by a drive shaft (turbine rotor) 24 extending inside the bearing housing 22. Thus, the turbine rotor 16, the impeller 20, and the drive shaft 24 are disposed on the same axis. The turbine rotor 16 of the turbine 10 is rotated by exhaust gas discharged from the internal combustion engine, for instance, whereby the impeller 20 of the compressor 12 is rotated via the drive shaft 24. Rotation of the impeller 20 of the compressor 12 compresses intake air to be supplied to the internal combustion engine.

The turbine housing 14 includes, for instance, a turbine casing 26, and an end wall (back plate) 28 disposed on an opening of the turbine casing 26 at the side of the bearing housing 22. The drive shaft 24 is inserted through the end wall 28. The end wall 28 is interposed between the turbine casing 26 and the bearing housing 22. The bearing housing 22 supports the drive shaft 24 rotatably via the bearing 30.

Furthermore, the compressor housing 18 includes, for instance, a compressor casing 32, and an end wall 34 joined to the compressor casing 32. The drive shaft 24 is inserted through the end wall 34. The end wall 34 is formed integrally with the bearing housing 22.

The turbine casing 26 includes a cylindrical section 36 which houses the turbine rotor 16, and a scroll section (volute section) 38 extending along the circumferential direction of the turbine rotor 16 and the cylindrical section 36. The cylindrical section 36 and the scroll section 38 are formed integrally by casting. With this configuration, since the cylindrical section 36 and the scroll section 38 are integrally formed by casting, the turbine casing 26 can be produced readily. Furthermore, in some embodiments, the turbine casing 26 includes an intake section 42 for a fluid continuing to an inlet of the scroll section 38. The outlet of the fluid is formed by the cylindrical section 36.

The cylindrical section 36 is formed into a cylindrical shape centered at the axis of the turbine rotor 16, and the turbine rotor 16 is housed in the root side (bearing housing 22 side) of the cylindrical section 36. The root side of the cylindrical section 36 forms the shroud 44 of a cylindrical shape that defines an operational flow path 17 between the shroud 44 and the turbine rotor 16.

The scroll section 38 is formed into a spiral shape centered at the axis (center line) of the shroud 44. The scroll section 38 has an outer peripheral wall (scroll outer peripheral wall) 46 and a partition wall 54.

The outer peripheral wall 46 continues to one end side of the shroud 44 and extends along the circumferential direction of the shroud 44.

FIGS. 3 to 7 are each a schematic transverse cross-sectional view of a turbine, according to some embodiments.

Figure 3:
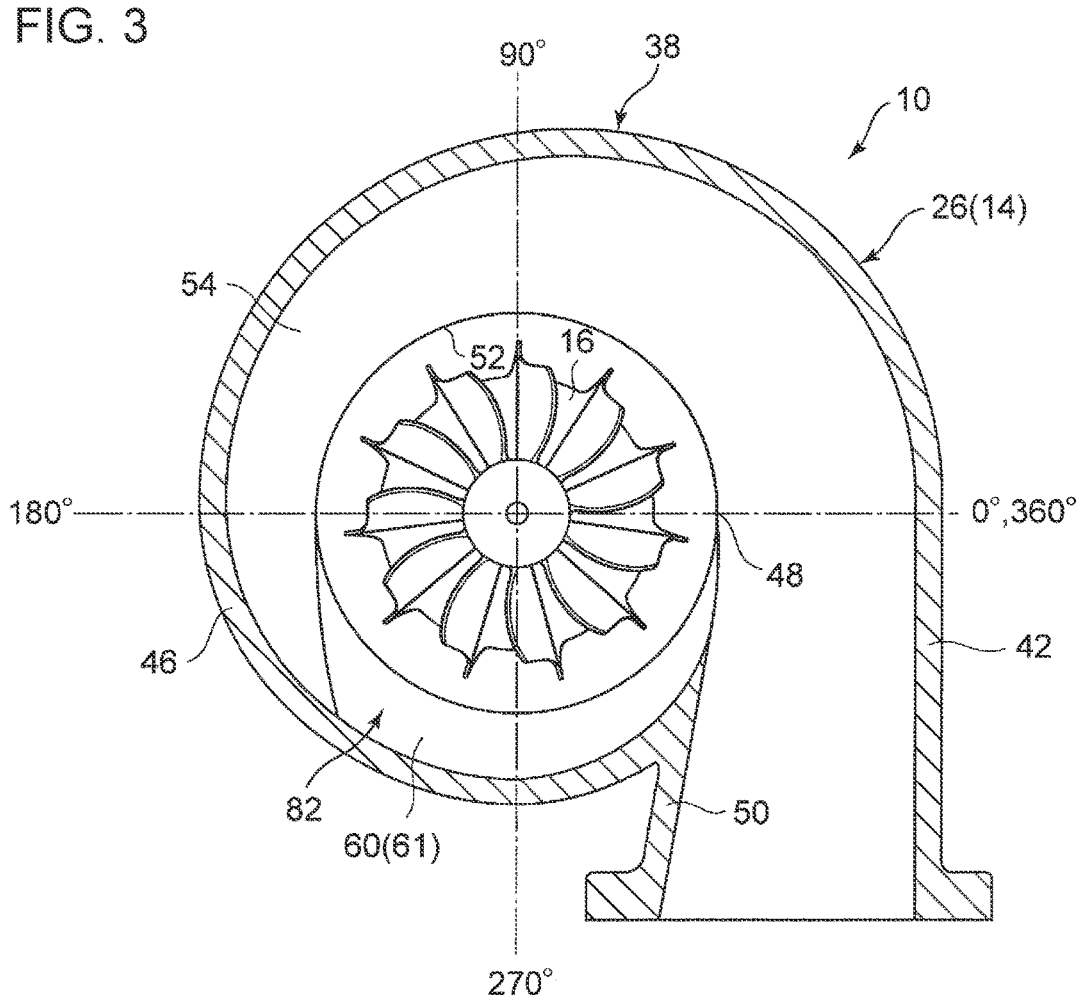
FIG. 3 is a schematic transverse cross-sectional view of a turbine according to an embodiment.

As depicted in FIG. 3, the inlet (starting end) of the scroll section 38 is at the position of zero degree in the circumferential direction of the turbine rotor 16 (the circumferential position θ of the inlet is at zero degree). The circumferential position θ of zero degree is defined as the position of the tip of the tongue section 48. The tongue section 48 is a section where the outer peripheral wall 46 of the scroll section 38 of the turbine casing 26 and the wall 50 of the intake section 42 intersect with each other at an acute angle.

The terminating end of the scroll section 38 is at the position of 360° in the circumferential direction of the turbine rotor 16 (the circumferential position θ of the terminating end is at 360°). Accordingly, the circumferential position θ of the terminating end of the scroll section 38 coincides with the circumferential position of the tongue section 48.

The value of the circumferential position θ increases from the inlet toward the terminating end of the scroll section 38, and the direction along the flow of the fluid in the scroll section 38 is defined as the positive direction.

The inner peripheral edge of the scroll section 38 is defined by a virtual circle 52 touching the tongue section 48 centered at the axis (center line) of the shroud 44, while the outer peripheral edge of the scroll section 38 is defined by the outer peripheral wall 46 of the scroll section 38.

As depicted in FIGS. 1 and 2, the outer peripheral wall 46 has a C-shape in a cross section perpendicular to the circumferential direction of the shroud 44 at each circumferential position θ. The partition wall 54 is disposed inside the outer peripheral wall 46 and extends along the circumferential direction of the shroud 44.

The partition wall 54 divides the inside of the outer peripheral wall 46 of the scroll section 38 into the first scroll flow path 56 and the second scroll flow path 58 disposed adjacent to each other in the axial direction of the shroud 44. The outer peripheral edge of the partition wall 54 continues integrally to the inner peripheral surface of the outer peripheral wall 46. The inner peripheral edge of the partition wall 54 is defined by the virtual circle 52 touching the tongue section 48 centered at the axis of the shroud 44.

In some embodiments, the internal combustion engine is a four-cylinder engine, with the first cylinder and the fourth cylinder connected to the first scroll flow path 56 and the second cylinder and the third cylinder connected to the second scroll flow path 58. Normally, the phase of the crank angle of the first cylinder and the fourth cylinder is different by 180 degrees from the phase of the crank angle of the second cylinder and the third cylinder. In this case, the timing at which exhaust gas flows into the first scroll flow path 56 from the first cylinder and the fourth cylinder is different from the timing at which exhaust gas flows into the second scroll flow path 58 from the second cylinder and the third cylinder.

As depicted in FIG. 2, the flow-path area A1 of the first scroll flow path 56 is defined as an area of a cross-section perpendicular to the circumferential direction of the shroud 44 of a space (first space) defined by the inside of the outer peripheral wall 46 and the partition wall 54. The flow-path area A2 of the second scroll flow path 58 is defined as an area of another space (second space) defined by the inside of the outer peripheral wall 46 and the partition wall 54. Furthermore, the sum of the flow-path area A1 of the first scroll flow path 56 and the flow-path area A2 of the second scroll flow path 58 is defined as the flow-path area A of the scroll section 38.

Furthermore, the distance from the flow-path center C1 of the first scroll flow path 56 to the axis of the shroud 44 is defined as R1, and the distance from the flow-path center C2 of the second scroll flow path 58 to the axis of the axis of the shroud 44 is defined as R2. The distance from the flow-path center of a flow-path combining the first scroll flow path 56 and the second scroll flow path 58 to the axis of the shroud 44 is defined as R.

A1/R1 is a ratio of the flow-path area A1 to the distance R1, and A2/R2 is a ratio of the flow-path area A2 to the distance R2. A/R corresponds to the sum of the ratio A1/R1 of the flow-path area A1 to the distance R1 of the first scroll flow path 56, and the ratio A2/R2 of the flow-path area A2 to the distance R2 of the second scroll flow path 58.

In a strict sense, each of A1/R1, A2/R2, and A/R is defined by the following expression (1), where r is the position in the radial direction of the turbine rotor 16, and dA is the minute area element of each flow-path cross section of the first scroll flow path 56, the second scroll flow path 58, and the flow path combining the aforementioned flow paths. If the areas A1, A2 and the cross-sectional shapes of the flow-path cross sections of the first scroll flow path 56 and the second scroll flow path 58 are known, the distances R1, R2, and R can be determined on the basis of the expression (1). To simplify the matter, the distances R1, R2, and R can be substituted by the distances from the axis of the shroud 44 to the respective centroids of the first scroll flow path 56, the second scroll flow path 58, and the flow-path combining the aforementioned flow paths.

(Expression 1)

$$A/R = \int_A \frac{1}{r}\, dA \tag{1}$$

As depicted in FIGS. 3 to 7, in some embodiments, the partition wall 54 has a widening section 82 that partially widens the communication area between at least two of the first scroll flow path 56, the second scroll flow path 58, and the operational flow path 17 in the circumferential direction of the shroud 44.

With this configuration, the turbine casing 26 has the widening section 82 that widens the communication area between at least two of the first scroll flow path 56, the second scroll flow path 58, and the operational flow path 17, and thus the thickness of the core increases at the section corresponding to the widening section 82. As a result, it is possible to enhance the strength of the core for casting the turbine casing 26.

With this configuration, even if the turbine casing 26 is small, the turbine casing 26 can be produced readily by casting. Thus, it is possible to provide the downsized turbine 10 at low cost and with high productivity.

As depicted in FIGS. 3 to 6, in some embodiments, the widening section 82 includes at least one cutout portion 60 disposed on an inner peripheral side of the partition wall 54.

With this configuration, the communication area between the first scroll flow path 56 and the second scroll flow path 58 is increased at the cutout portion 60 disposed in the partition wall 54, and the thickness of the core increases at a part corresponding to the cutout portion 60. As a result, it is possible to enhance the strength of the core for casting the turbine casing 26.

Figure 4:
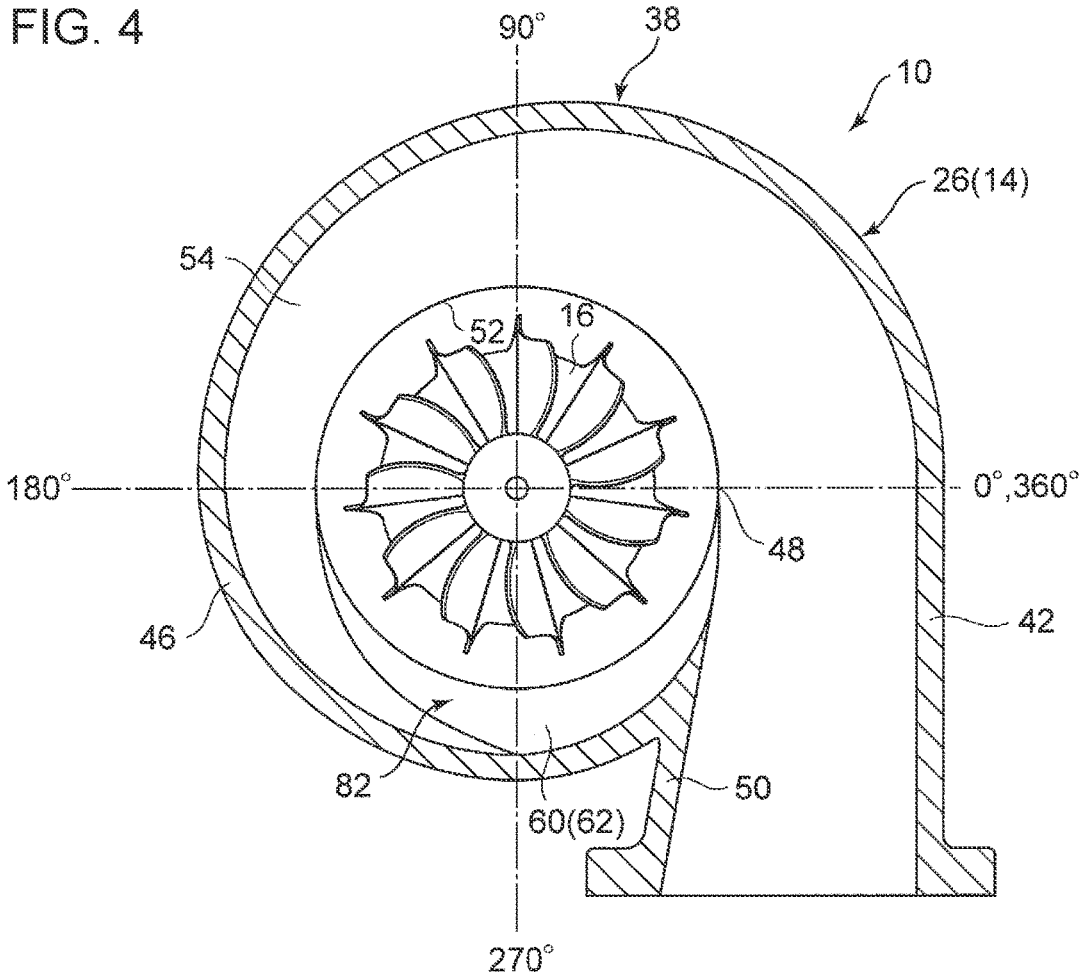
FIG. 4 is a schematic transverse cross-sectional view of a turbine according to an embodiment.

As depicted in FIGS. 3 and 4, in some embodiments, when a position in the circumferential direction of the shroud 44 is represented with reference to the position of the tongue section 48 as the zero-degree position and the flow direction of the fluid as the positive direction, the at least one cutout portion 60 includes a downstream cutout portion 61 or 62 extending downstream in the flow direction of the fluid starting from the position of at least 90 and no more than 270 degrees in the circumferential direction of the shroud 44. In other words, the upstream end of the downstream cutout portion 61, 62 is at the position of at least 90 and no more than 270 degrees.

With this configuration, the communication area between the first scroll flow path 56 and the second scroll flow path 58 is increased at the downstream cutout portion 61, 62 disposed on the partition wall 54, and the thickness of the core increases at a part corresponding to the downstream cutout portion 61, 62. As a result, it is possible to enhance the strength of the core for casting the turbine casing 26.

Furthermore, the flow rate of the fluid is smaller at the downstream side than at the upstream side of the first scroll flow path 56 and the second scroll flow path 58. Thus, with the downstream cutout portion 61, 62 provided as the cutout portion 60, it is possible to suppress change in the flow velocity or the pressure of a fluid.

As depicted in FIGS. 3 and 4, in some embodiments, the downstream cutout portion 61, 62 has an upstream end, with respect to the flow direction of the fluid, at the position of 180 degrees in the circumferential direction of the shroud 44. Furthermore, the downstream cutout portion 61, 62 is enlarged gradually in the flow direction of the fluid, and the partition wall 54 is flush with the inner peripheral surface of the outer peripheral wall 46 at the position of at least 180 and no more than 270 degrees in the circumferential direction of the shroud 44.

As depicted in FIG. 3, in some embodiments, the downstream cutout portion 61 is enlarged along the tangent direction of the inner peripheral edge of the partition wall 54 or the virtual circle 52 at the upstream end.

As depicted in FIG. 4, in some embodiments, the downstream cutout portion 62 is enlarged gradually from the upstream end toward the downstream end, and is flush with the inner peripheral surface of the outer peripheral wall 46 at the position of 270 degrees.

Figure 11:
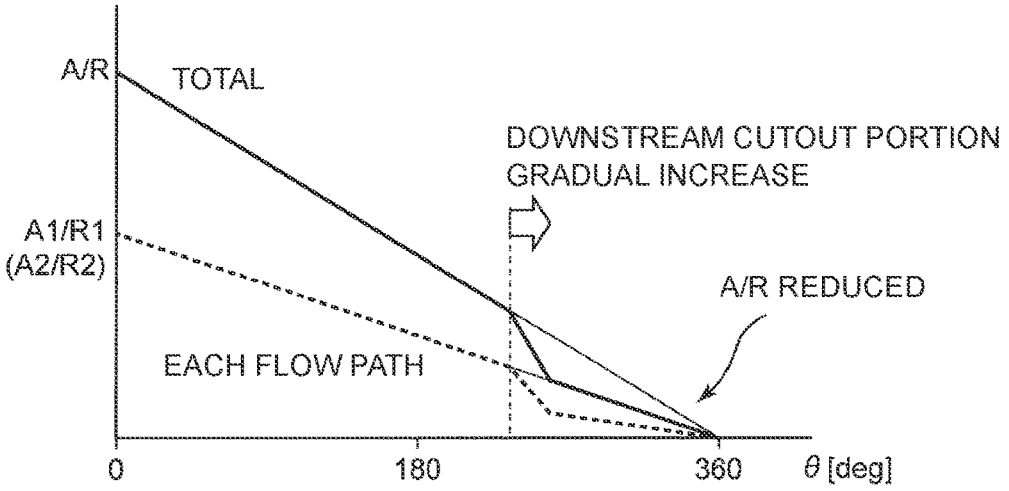
FIG. 11 is a graph showing a relationship between the circumferential position θ and A/R, where x-axis is the circumferential position θ about the axis of a shroud, and y-axis is A/R.

FIG. 11 is a graph showing a relationship between the circumferential position θ and A/R, where x-axis is the circumferential position θ about the axis of the shroud 44, and y-axis is A/R. As depicted in FIG. 11, in some embodiments, A/R (A1/R1, A2/R2) of each of the first scroll flow path 56 and the second scroll flow path 58 is decreasing smoothly, and the sum A/R thereof is also decreasing smoothly. Furthermore, the downstream cutout portion 61, 62 has an upstream end, with respect to the flow direction of the fluid, at the position of at least 180 and no more than 270 degrees in the circumferential direction of the shroud 44.

Further, in some embodiments, the downstream cutout portion 61, 62 is gradually enlarged in the flow direction of the fluid, and has such a shape that, after the partition wall 54 becomes flush with the inner peripheral surface of the outer peripheral wall 46, A/R of the downstream cutout portion 61, 62 (scroll flow path) is smaller than the A/R distribution in a case where the total A/R of the first scroll flow path 56 and the second scroll flow path 58 at the upstream side of the downstream cutout portion 61, 62 linearly decreases toward 360 degrees.

With this configuration, A/R of the first scroll flow path 56 and the second scroll flow path 58 in a flow region where the downstream cutout portion 61, 62 is formed is smaller than the A/R distribution in a case where the total A/R of the first scroll flow path 56 and the second scroll flow path 58 at the upstream side of the downstream cutout portion 61, 62 linearly decreases toward 360 degrees, and thereby an increase in the flow-path area is suppressed in the flow region with the downstream cutout portion 61, 62, which suppresses change in the flow velocity and the pressure in the fluid.

Further, in some embodiments, the downstream cutout portion 61, 62 (scroll flow path) has such a shape that A/R of the downstream cutout portion 61, 62 is no more than 80% of the A/R distribution in a case where the total A/R of the first scroll flow path 56 and the second scroll flow path 58 at the upstream side of the downstream cutout portion 61, 62 linearly decreases toward 360 degrees.

With this configuration, since A/R of the first scroll flow path 56 and the second scroll flow path 58 in a flow region where the downstream cutout portion 61, 62 is formed is no more than 80% of the A/R distribution in a case where the total A/R of the first scroll flow path 56 and the second scroll flow path 58 at the upstream side of the downstream cutout portion 61, 62 linearly decreases toward 360 degrees, an increase in the flow-path area is suppressed in the flow region with the downstream cutout portion 61, 62, which suppresses change in the flow velocity and the pressure of the fluid.

Further, in some embodiments, as depicted in FIG. 11, A/R of the downstream cutout portion 61, 62 (scroll flow path) decreases at the same rate as A/R of the first scroll flow path 56 or the second scroll flow path 58 with respect to the change in the circumferential position θ. In this case, as depicted in FIG. 11, a line representing A/R of the flow path (scroll flow path) after merger of the first scroll flow path 56 and the second scroll flow path 58 is on the extension of the line representing A/R (A1/R1, A2/R2) of the first scroll flow path 56 or the second scroll flow path 58.

With this configuration, A/R at the downstream cutout portion after merger between the first scroll flow path 56 and the second scroll flow path 58 decreases at the same rate as A/R (A1/R1, A2/R2) of the first scroll flow path 56 or the second scroll flow path 58, and thereby a flow of a fluid (exhaust gas) is smoothed.

Figure 5:
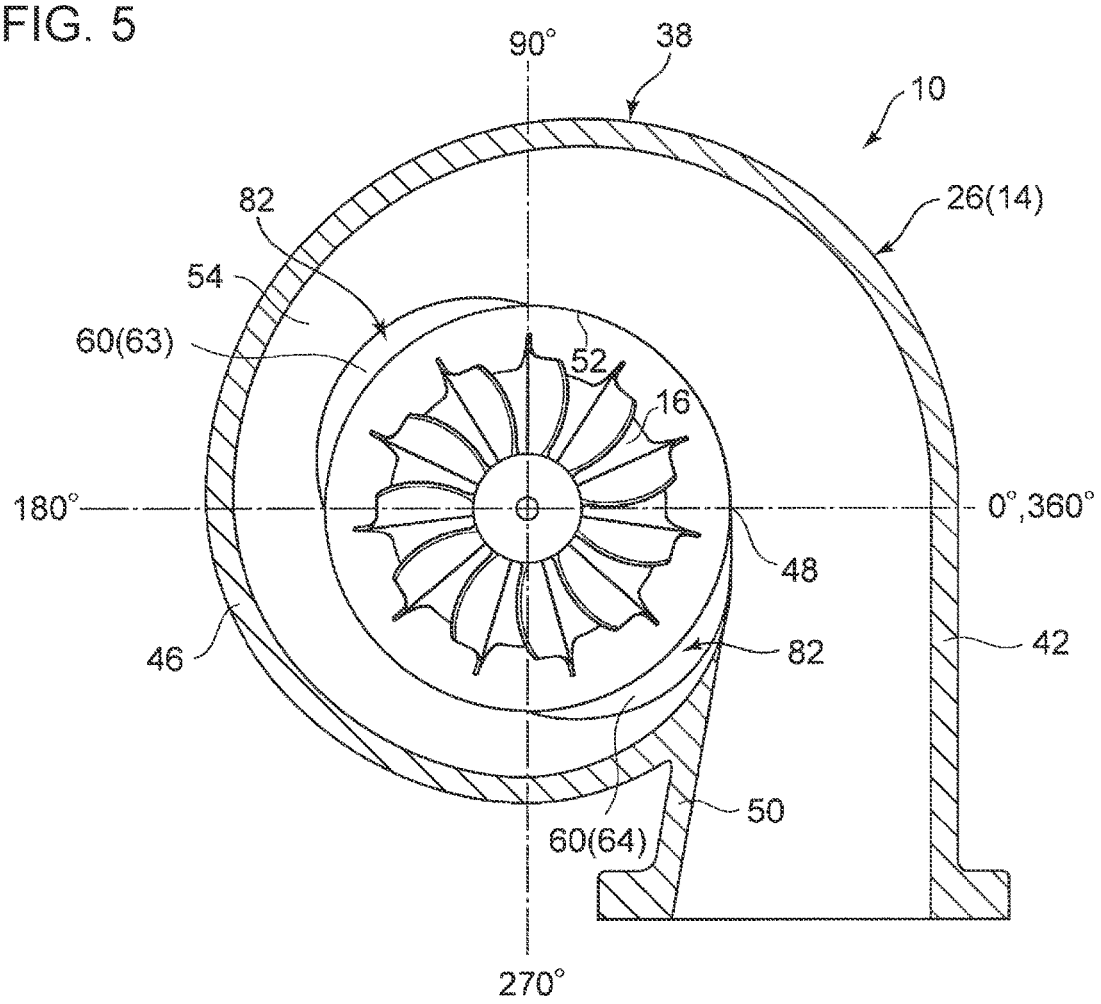
FIG. 5 is a schematic transverse cross-sectional view of a turbine according to an embodiment.
Figure 6:
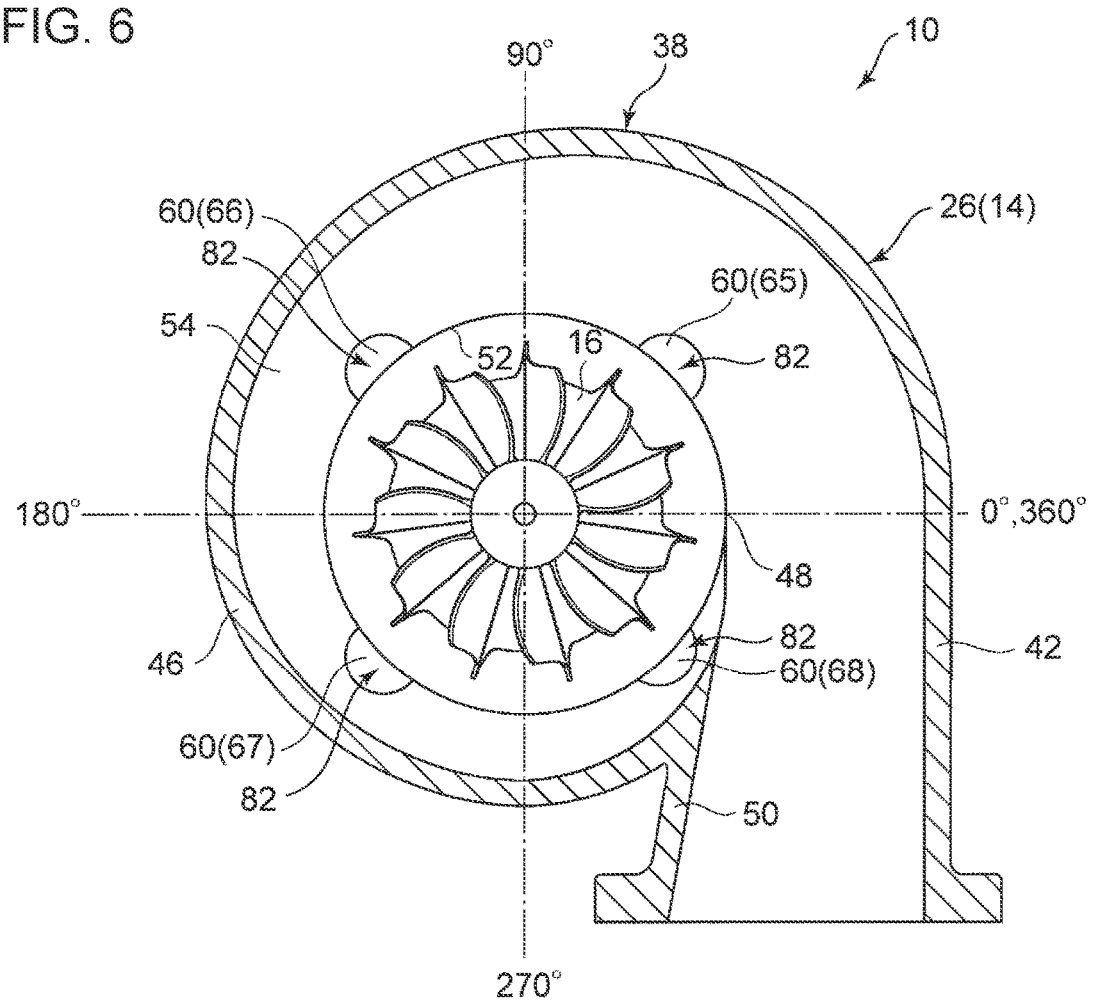
FIG. 6 is a schematic transverse cross-sectional view of a turbine according to an embodiment.

As depicted in FIGS. 5 and 6, in some embodiments, the widening section 82 includes at least one cutout portion 60 disposed on an inner peripheral side of the partition wall 54.

In some embodiments, at least one cutout portion 60 comprises a plurality of cutout portions 60 disposed rotationally symmetric about the axis of the shroud 44.

With this configuration, the communication area between the first scroll flow path 56 and the second scroll flow path 58 is increased at the plurality of cutout portions 60 disposed rotationally symmetric about the axis of the shroud 44, and the thickness of the core increases at the sections corresponding to the plurality of cutout portions 60. As a result, it is possible to enhance the strength of the core for casting the turbine casing 26.

As depicted in FIG. 5, in some embodiments, cutout portions 60 are provided at the position of at least 90 and no more than 180 degrees and the position of at least 270 and no more than 360 degrees in the circumferential direction of the shroud 44 (hereinafter, referred to as "upstream cutout portion 63" and "downstream cutout portion 64", respectively).

As depicted in FIG. 5, in some embodiments, the upstream cutout portion 63 and the downstream cutout portion 64 have the same shape and provided over a broad range, cut out in an arc shape toward the outer peripheral wall (scroll outer peripheral wall) from the virtual circle 52 touching the above described tongue section 48. Accordingly, the upstream cutout portion 63 and the downstream cutout portion 64 are gradually enlarged in the flow direction of the fluid, and then gradually narrowed.

With this configuration, the communication area between the first scroll flow path 56 and the second scroll flow path 58 is increased at the upstream cutout portion 63 and the downstream cutout portion 64, and the thickness of the core increases at the sections corresponding to the upstream cutout portion 63 the downstream cutout portion 64. As a result, it is possible to enhance the strength of the core for casting the turbine casing 26 at two locations.

Furthermore, as depicted in FIG. 6, in some embodiments, cutout portions 60 are provided at the position of at least 0 and no more than 90 degrees, the position of at least 90 and no more than 180 degrees, the position of at least 180 and no more than 270 degrees, and the position of at least 270 and no more than 360 degrees, in the circumferential direction of the shroud 44 (hereinafter, referred to as "first cutout portion 65" "second cutout portion 66", "third cutout portion 67" and "fourth cutout portion 68", respectively).

As depicted in FIG. 6, in some embodiments, the first cutout portion 65, the second cutout portion 66, the third cutout portion 67 and the fourth cutout portion 68 have the same shape and disposed at regular intervals in the circumferential direction of the shroud 44. Furthermore, in some embodiments, similarly to the above described upstream cutout portion 63 and the downstream cutout portion 64, the first cutout portion 65, the second cutout portion 66, the third cutout portion 67 and the fourth cutout portion 68 are cutout in an arc shape toward the outer peripheral wall 46 (scroll outer peripheral wall) from the virtual circle 52 touching the above described tongue section 48, but in a range narrower than that of the above described upstream cutout portion 63 and the downstream cutout portion 64. Accordingly, the first cutout portion 65, the second cutout portion 66, the third cutout portion 67 and the fourth cutout portion 68 have a smaller radius than the above described upstream cutout portion 63 and the downstream cutout portion 64.

With this configuration, the communication area between the first scroll flow path 56 and the second scroll flow path 58 is increased at the first cutout portion 65, the second cutout portion 66, the third cutout portion 67 and the fourth cutout portion 68, and the thickness of the core increases at the parts corresponding to the first cutout portion 65, the second cutout portion 66, the third cutout portion 67 and the fourth cutout portion 68. As a result, it is possible to enhance the strength of the core for casting the turbine casing 26 at four locations with a good balance.

Figure 7:
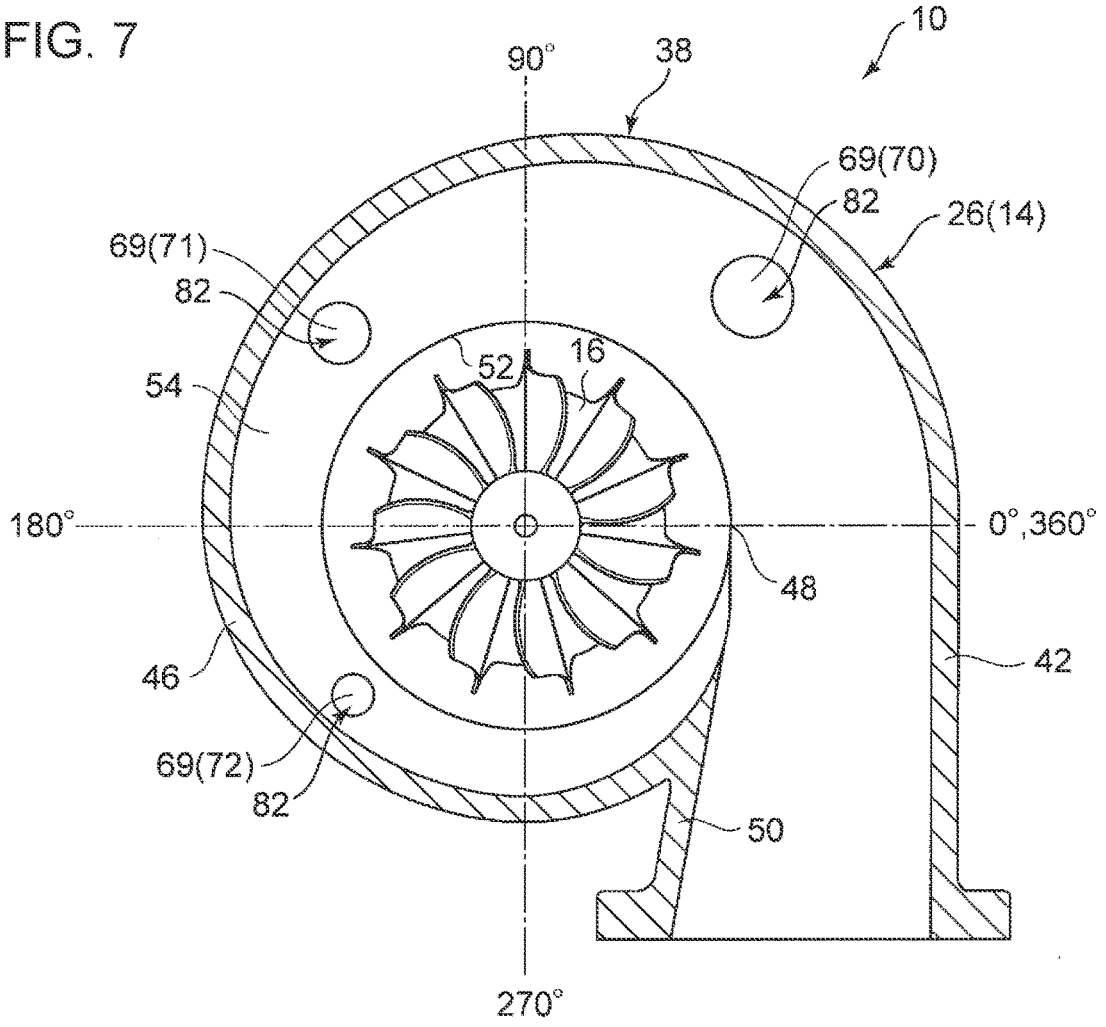
FIG. 7 is a schematic transverse cross-sectional view of a turbine according to an embodiment.
Figure 12:
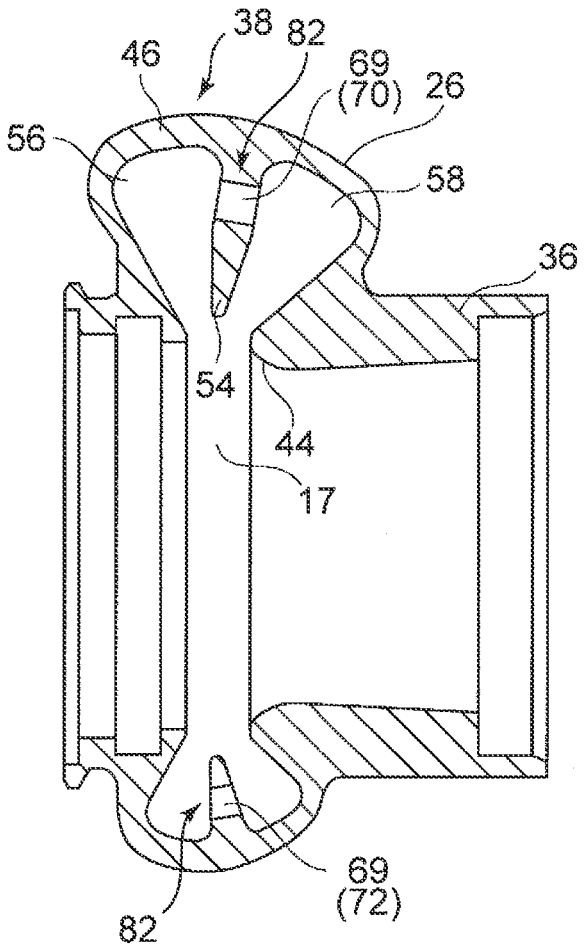
FIG. 12 is a schematic cross-sectional view of the turbine casing depicted in FIG. 7.
Figure 13:
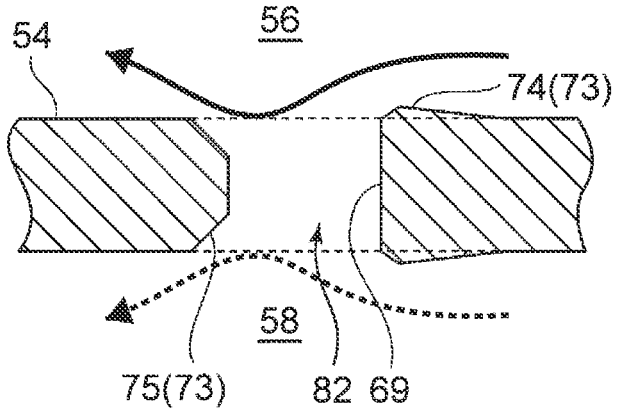
FIG. 13 is a schematic diagram of the through hole in FIG. 12.

FIG. 12 is a schematic cross-sectional view of the turbine casing in FIG. 7. FIG. 13 is a schematic diagram of the through hole in FIG. 12.

As depicted in FIGS. 7 and 12, in some embodiments, the widening section 82 includes at least one through hole 69 disposed on the partition wall 54.

With this configuration, the first scroll flow path 56 and the second scroll flow path 58 are in communication with each other via the through hole 69 formed on the partition wall 54, and a part of the core corresponding to the first scroll flow path 56 and a part of the core corresponding to the second scroll flow path 58 are connected at a part of the core corresponding to the through hole 69. As a result, it is possible to enhance the strength of the core for casting the turbine casing 26.

As depicted in FIGS. 7 and 12, in some embodiments, a plurality of through holes 70, 71, 72 is disposed about the axis of the shroud 44.

With this configuration, the first scroll flow path 56 and the second scroll flow path 58 are in communication with each other via the plurality of through holes 70, 71, 72 formed on the partition wall 54, and a part of the core corresponding to the first scroll flow path 56 and a part of the core corresponding to the second scroll flow path 58 are connected at parts of the core corresponding to the plurality of through holes 70, 71, 72. As a result, it is possible to enhance the strength of the core for casting the turbine casing 26.

As depicted in FIGS. 7 and 12, in some embodiments, the through holes 70, 71, 72 are provided respectively at the position of at least 0 and no more than 90 degrees, the position of at least 90 and no more than 180 degrees, and the position of at least 180 and no more than 270 degrees in the circumferential direction of the shroud 44.

In some embodiments, the through holes 70, 71, 72 are provided at the positions of 45 degrees, 135 degrees, and 225 degrees, respectively.

In some embodiments, the diameters of the through holes 70, 71, 72 become smaller in stages along the flow direction of the fluid. In some embodiments, the diameters become smaller in the following order: the through hole 70 disposed on the position of 45 degrees, the through hole 71 disposed on the position of 135 degrees, and the through hole 72 disposed on the position of 225 degrees.

With this configuration, the communication area between the first scroll flow path 56 and the second scroll flow path 58 is increased at the through hole 70 disposed at the position of 45 degrees, the through hole 70 disposed at the position of 135 degrees, and the through hole 71 disposed at the position of 225 degrees. Accordingly, a part of the core corresponding to the first scroll flow path 56 and a part of the core corresponding to the second scroll flow path 58 are connected at parts of the core corresponding to the through hole 70 disposed at the position of 45 degrees, the through hole 70 disposed at the position of 135 degrees, and the through hole 71 disposed at the position of 225 degrees. As a result, it is possible to enhance the strength of the core for casting the turbine casing 26.

As depicted in FIG. 13, in some embodiments, the partition wall 54 has a rectifying portion 73 around the through hole 69.

With this configuration, the flow of a fluid flowing about the through hole 69 is rectified, and thereby it is possible to reduce a leak flow between the first scroll flow path 56 and the second scroll flow path 58.

As depicted in FIG. 13, in some embodiments, the rectifying portion 73 reduces leakage of a fluid from one of the flow paths (e.g. the first scroll flow path 56) to the other one of the flow paths (e.g. the second scroll flow path 58). As depicted in FIG. 13, in some embodiments, the rectifying portion 73 has a thickness-increasing portion 74 disposed upstream of the through hole 69 and increasing gradually in thickness toward the downstream side, and a thickness-decreasing portion 75 disposed downstream of the through hole 69 and decreasing gradually in thickness toward the upstream side.

With this configuration, the fluid flows along the surface (inclined surface) of the thickness-increasing portion 74, and a flow of the fluid flowing toward the through hole 69 is suppressed. Furthermore, even if the fluid is attracted toward the through hole 69 when flowing by the side surface around the through hole 69, the fluid flows along the surface (inclined surface) of the thickness-decreasing portion 75, and a flow of the fluid in a direction to pass through the through hole 69 is suppressed. As a result, it is possible to suppress leakage of the fluid from one of the flow paths to the other one of the flow paths.

Figure 8:
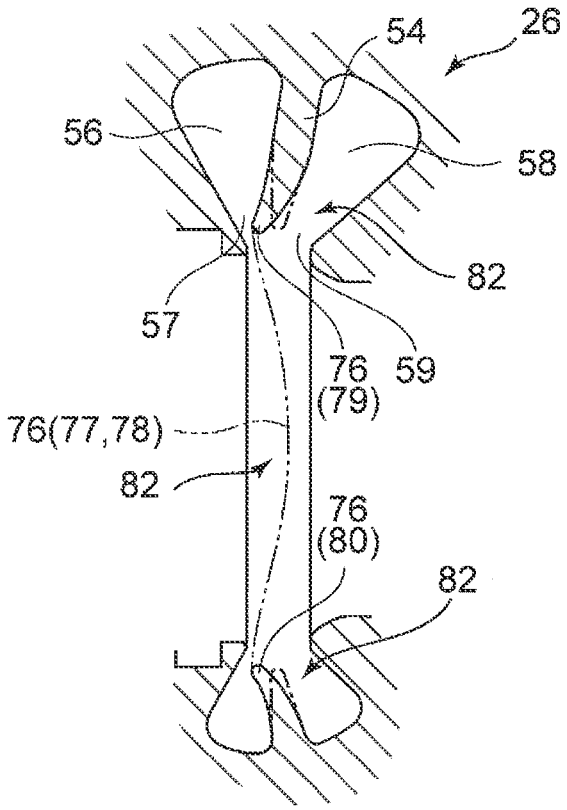
FIG. 8 is a conceptual diagram showing a trajectory of an inner peripheral edge of a partition wall of a turbine casing according to an embodiment.
Figure 9:
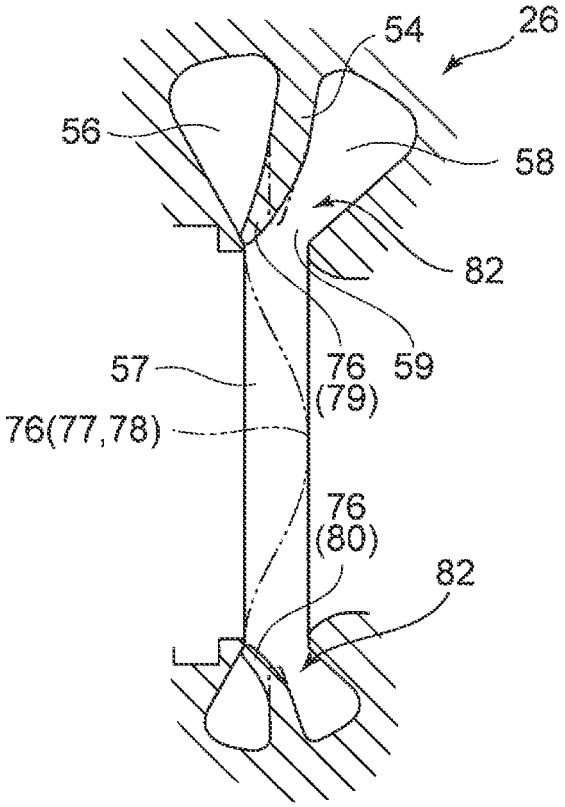
FIG. 9 is a conceptual diagram showing a trajectory of an inner peripheral edge of a partition wall of a turbine casing according to an embodiment.

FIGS. 8 and 9 are each a conceptual diagram showing a trajectory of an inner peripheral edge of a partition wall of a turbine casing according to some embodiments. In FIGS. 8 and 9, the inner peripheral edge of the partition wall 54 of the turbine casing 26 is indicated by the two-dotted chain line.

As depicted in FIGS. 8 and 9, in some embodiments, the widening section 82 includes at least one bend portion 76 disposed on an inner peripheral side of the partition wall 54.

With this configuration, the bend portion 76 disposed on the inner peripheral side of the partition wall 54 increases the communication area between the first scroll flow path 56 and the operational flow path 17, or the communication area between the second scroll flow path 58 and the operational flow path 17. In this case, the thickness of the core increases at the core joint section connecting a part of the core corresponding to the first scroll flow path 56 and a part of the core corresponding to the operational flow path 17, or at the core joint section connecting a part of the core corresponding to the second scroll flow path 58 and a part of the core corresponding to the operational flow path 17. As a result, it is possible to enhance the strength of the core for casting the turbine casing 26.

In some embodiments, the at least one bend portion 76 includes at least one first bend portions 77, 78 widening a throat portion 57 of the first scroll flow path 56 facing the operational flow path 17, and at least one second bend portions 79, 80 widening a throat portion 59 of the second scroll flow path 58 facing the operational flow path 17.

With this configuration, the first bend portions 77, 78 increase the thickness of a part of the core corresponding to the throat portion 57 of the first scroll flow path 56, while the second bend portions 79, 80 increase the thickness of a part of the core corresponding to the throat portion 59 of the second scroll flow path 58. Accordingly, the thickness of the core increases at both of the core joint section connecting a part of the core corresponding to the first scroll flow path 56 and a part of the core corresponding to the operational flow path 17, and the core joint section connecting a part of the core corresponding to the second scroll flow path 58 and a part of the core corresponding to the operational flow path 17. As a result, it is possible to enhance the strength of the core for casting the turbine casing 26.

In some embodiments, as depicted in FIGS. 8 and 9, the first bend portions 77, 78 and the second bend portions 79, 80 are disposed alternately at positions that equally divide the shroud 44 into four sections in the circumferential direction. Accordingly, the first bend portions 77, 78 and the second bend portions 79, 80 are disposed in pairs in the circumferential direction of the shroud 44. Specifically, in the circumferential direction of the shroud 44, the first bend portions 77, 78 are disposed centered at the positions of 180 degrees and 360 degrees, and the second bend portions 79, 80 are disposed centered at the positions of 90 degrees and 270 degrees.

With this configuration, the first bend portions 77, 78 widen the communication area between the first scroll flow path 56 and the operational flow path 17, and the thickness of the core increases at the sections forming the first bend portions 77, 78. Furthermore, the second bend portions 79, 80 widen the communication area between the first scroll flow path 56 and the operational flow path 17, and the thickness of the core increases at the sections forming the throat portions 57, 59. As a result, it is possible to enhance the strength of the core for casting the turbine casing 26.

In some embodiments, as depicted in FIG. 8, the bend portions 77, 78 widen the throat portion 57 of the first scroll flow path 56 and narrow the throat portion 59 of the second scroll flow path 58, while the second bend portions 79, 80 widen the throat portion 59 of the second scroll flow path 58 and narrow the throat portion 57 of the first scroll flow path 56.

With this configuration, the throat portion 57 of the first scroll flow path 56 is widened the most and the throat portion 59 of the second scroll flow path 58 is narrowed the most at the positions of 180 degrees and 360 degrees in the circumferential direction of the shroud 44. Similarly, the throat portion 59 of the second scroll flow path 58 is widened the most and the throat portion 57 of the first scroll flow path 56 is narrowed the most at the positions of 90 degrees and 270 degrees in the circumferential direction of the shroud 44.

In some embodiments, as depicted in FIG. 9, the bend portions 77, 78 widen the throat portion 57 of the first scroll flow path 56 and close the throat portion 59 of the second scroll flow path 58, while the second bend portions 79, 80 widen the throat portion 59 of the second scroll flow path 58 and close the throat portion 57 of the first scroll flow path 56.

Figure 14:
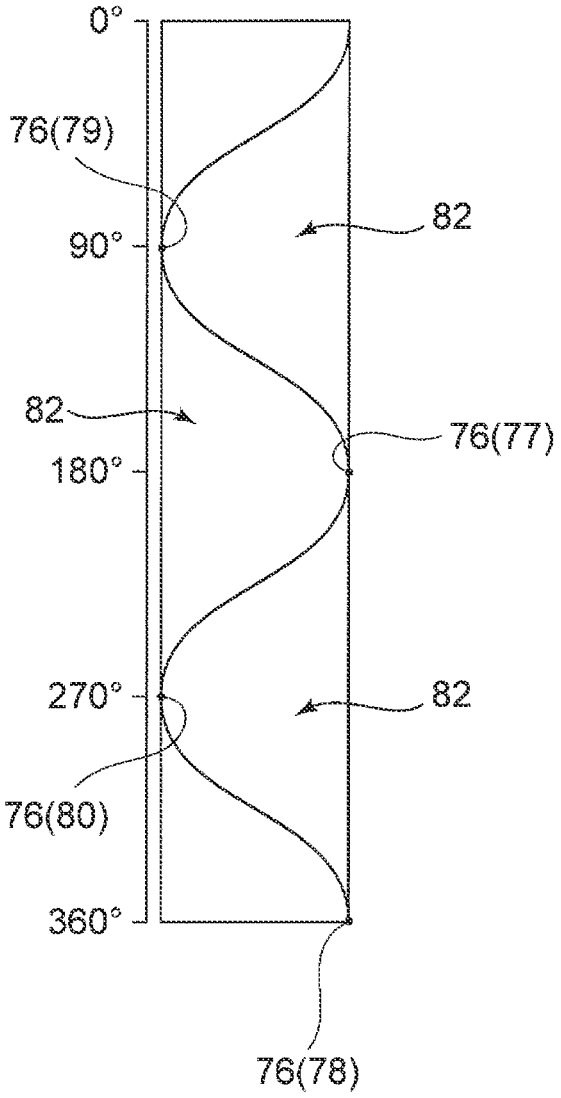
FIG. 14 is a schematic exploded view of the partition wall of the turbine casing in FIG. 9.

FIG. 14 is a schematic exploded view of the partition wall of the turbine casing in FIG. 9.

In some embodiments, as depicted in FIG. 14, the inner peripheral edge of the partition wall has a wavy shape (sine-wave shape) in an exploded view, due to formation of the bend portions 76.

With this configuration, the throat portion 57 of the first scroll flow path 56 is widened the most and the throat portion 59 of the second scroll flow path 58 is closed at the positions of 180 degrees and 360 degrees in the circumferential direction of the shroud 44. Similarly, the throat portion 59 of the second scroll flow path 58 is widened the most and the throat portion 57 of the first scroll flow path 56 is closed at the positions of 90 degrees and 270 degrees in the circumferential direction of the shroud 44.

Figure 10:
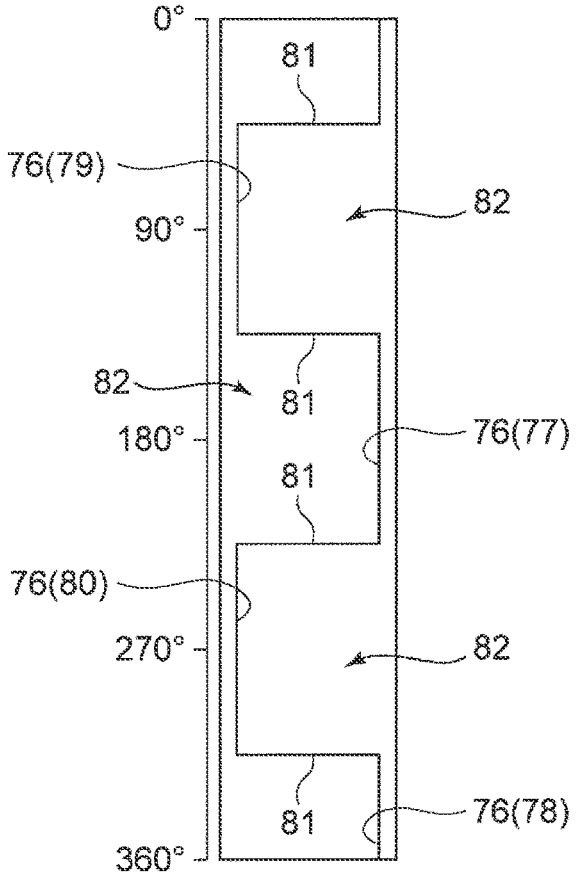
FIG. 10 is a schematic exploded view of a partition wall of a turbine casing according to an embodiment.

FIG. 10 is a schematic exploded view of a partition wall of a turbine casing according to an embodiment.

In some embodiments, as depicted in FIG. 10, the inner peripheral edge of the partition wall 54 has a square-wave shape in an exploded view, due to formation of the bend portions.

In some embodiments, the boundary portion 81 of the partition wall 54 disposed on the boundary between the first bend portions 77, 78 and the second bend portions 79, 80 extends inclining from the radial direction of the shroud 44 so as to smooth the flow of the fluid.

In some embodiments, as depicted in FIG. 10, the first bend portions 77, 78 widen the throat portion 57 of the first scroll flow path 56 and close the throat portion 59 of the second scroll flow path 58, and thereby a widening section (opening) of a square shape in an exploded view is formed at the throat portion 57 of the first scroll flow path 56. Similarly, the second bend portions 79, 80 widen the throat portion 59 of the second scroll flow path 58 and close the throat portion 57 of the first scroll flow path 56, and thereby a widening section (opening) of a square shape in an exploded view is formed at the throat portion 57 of the first scroll flow path 56.

With this configuration, the first bend portions 77, 78 widen the communication area between the first scroll flow path 56 and the operational flow path 17, and the thickness of the core increases at the sections forming the first bend portions 77, 78. Furthermore, the second bend portions 79, 80 widen the communication area between the first scroll flow path 56 and the operational flow path 17, and the thickness of the core increases at the sections forming the second bend portions 79, 80. As a result, it is possible to enhance the strength of the core for casting the turbine casing 26.

Figure 15:
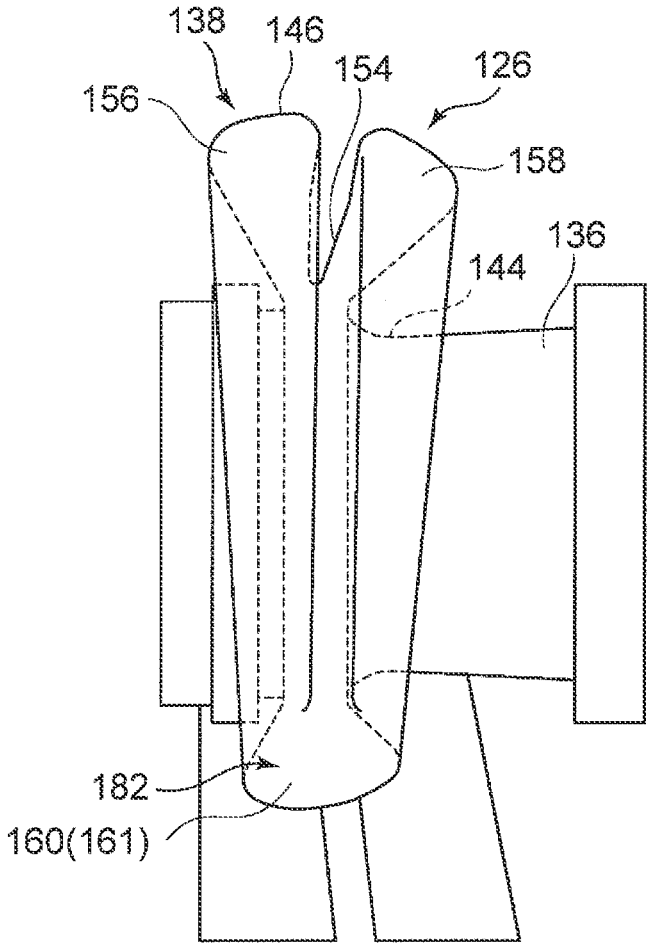
FIG. 15 is a schematic front view of a core for casting a turbine casing according to an embodiment.
Figure 16:
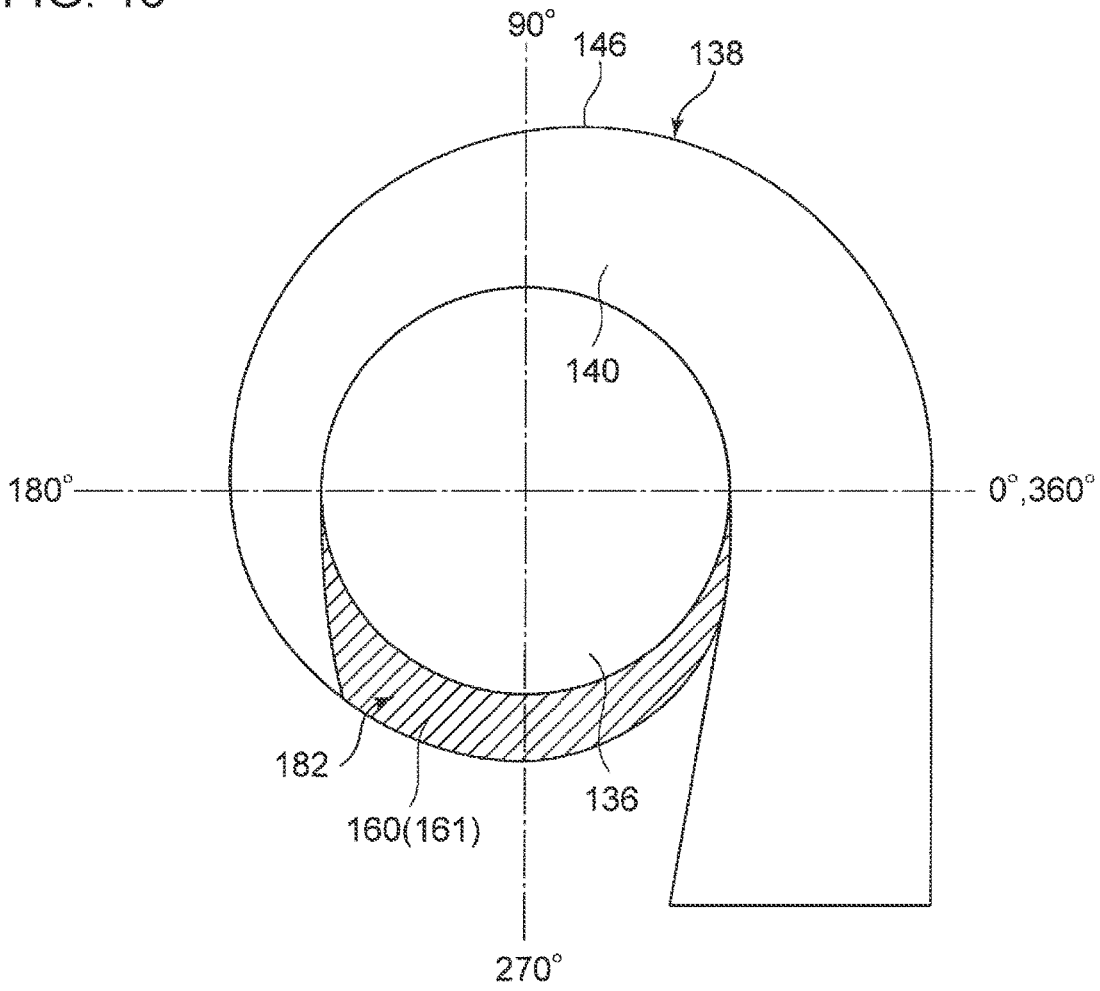
FIG. 16 is a schematic diagram of a transverse cross-section of the core depicted in FIG. 13.
Figure 17:
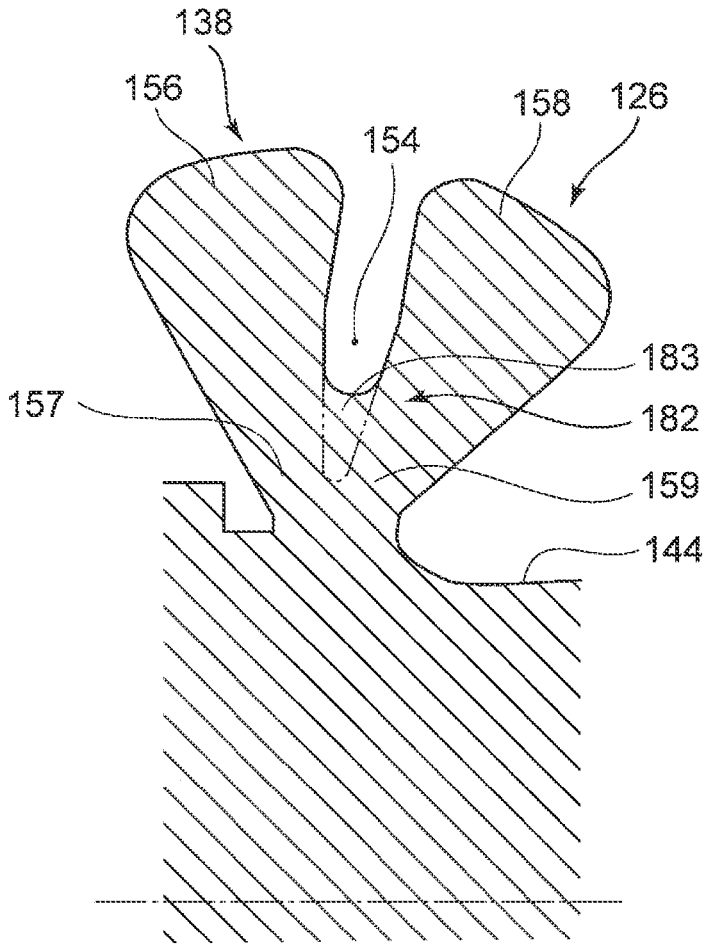
FIG. 17 is a conceptual diagram schematically showing a part of a core for casting a turbine casing according to an embodiment.
Figure 18:
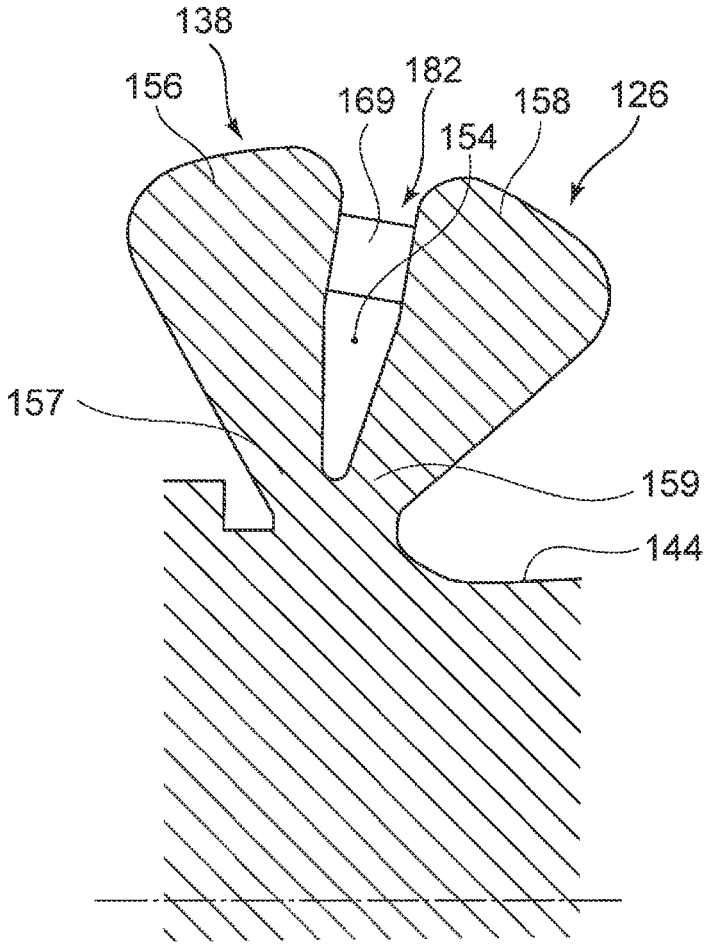
FIG. 18 is a conceptual diagram schematically showing a part of a core for casting a turbine casing according to an embodiment.
Figure 19:
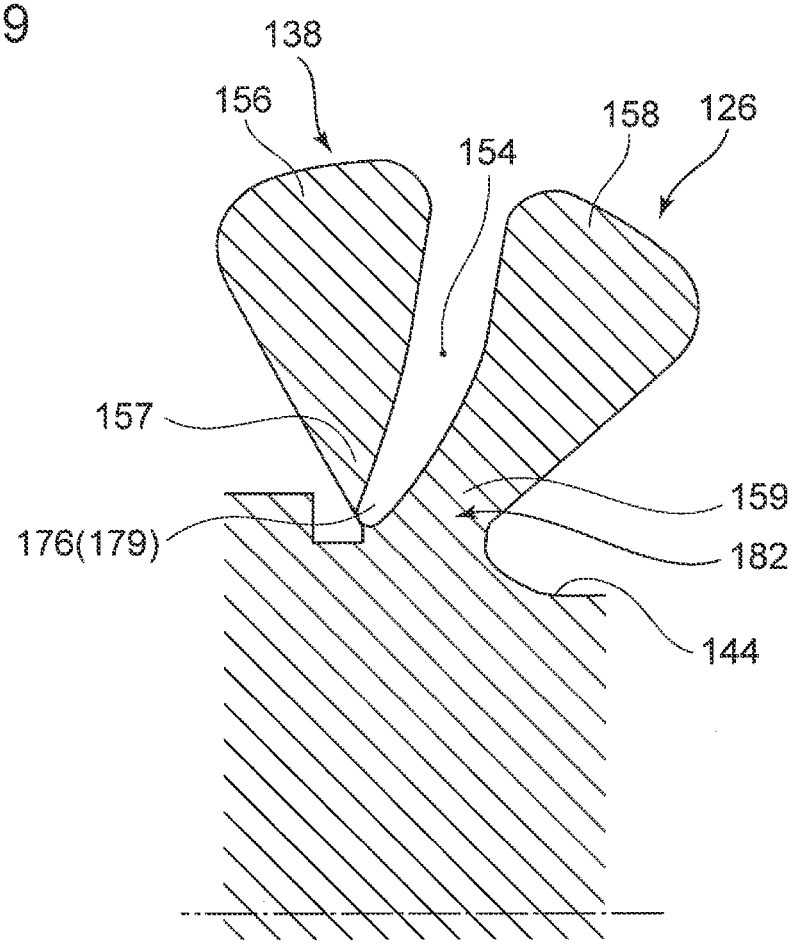
FIG. 19 is a conceptual diagram schematically showing a part of a core for casting a turbine casing according to an embodiment.

FIG. 15 is a schematic front view of a core for casting a turbine casing according to an embodiment, and FIG. 16 is a schematic diagram of a transverse cross-section of the core depicted in FIG. 15. FIGS. 17 to 19 are each a conceptual diagram schematically showing a part of a core for casting a turbine casing, according to some embodiments.

As depicted in FIGS. 15 to 19, in some embodiments, the core includes a shroud forming portion 144 for defining a runner corresponding to the shroud 44, an outer-peripheral wall forming portion 146 for defining a runner corresponding to the outer peripheral wall 46, a partition-wall forming portion 154 for defining a runner corresponding to the partition wall 54, and a reinforcement portion 182 disposed on a section of a runner corresponding to the widening section 82.

With this configuration, the thickness of the core increases at the reinforcement portion 182, and it is possible to enhance the strength of the core 126 for casting the turbine casing 26.

The core 126 for casting the turbine casing 26 forms a runner corresponding to the turbine casing 26 between a main mold (not depicted) and the core 126. The core 126 includes a cylinder forming portion 136 corresponding to the cylindrical section 36, and a scroll forming portion 138 corresponding to the scroll section 38.

The cylinder forming portion 136 is formed in a cylindrical shape having an outer peripheral shape that is the same as the inner peripheral shape of the cylindrical section 36. The cylinder forming portion 136 includes the shroud forming portion 144 corresponding to the shroud 44 and formed adjacent to the scroll forming portion 138. The shroud forming portion 144 is for defining a runner corresponding to the above described shroud 44 between the shroud forming portion 144 and a main mold, and forms a boundary between the cylinder forming portion 136 and the scroll forming portion 138.

The scroll forming portion 138 is formed into a spiral shape having an outer peripheral shape that is the same as the inner peripheral shape of the outer peripheral wall 46, centered at the axis (center line) of the cylinder forming portion 136. The scroll forming portion 138 has the outer-peripheral-wall forming portion 146 corresponding the outer peripheral wall 46 (scroll outer peripheral wall) 146 and the partition-wall forming portion 154 corresponding to the partition wall 54. The outer-peripheral-wall forming portion 146 is for defining a runner corresponding to the outer peripheral wall 46 between the outer-peripheral-wall forming portion 146 and the main mold, and formed in a spiral shape having an outer peripheral shape that is the same as the inner peripheral shape of the outer peripheral wall 46, centered at the axis (center line) of the shroud forming portion 144. The partition-wall forming portion 154 is for defining a runner corresponding to the partition wall 54 between the partition-wall forming portion 154 and the main mold, and formed in a V shape in cross section having an outer peripheral shape that is the same as the shape of the partition wall 54, centered at the axis of the shroud forming portion 144.

Accordingly, the partition-wall forming portion 154 divides the outer-peripheral-wall forming portion 146 into the first scroll forming portion 156 and the second scroll forming portion 158. The first scroll forming portion 156 defines a runner corresponding to the first scroll flow path 56, and the second scroll forming portion 158 defines a runner corresponding to the second scroll flow path 58. Furthermore, the partition-wall forming portion 154 includes the reinforcement portion 182. The reinforcement portion 182 is disposed on a section of a runner corresponding to the above described widening section 82, with the position, the size, and the range suitably set.

As depicted in FIGS. 15 and 16, in some embodiments, the reinforcement portion 182 includes a cutout reinforcement portion 160 disposed on a section of a runner corresponding to the cutout portion 60.

With this configuration, the thickness of the core 126 increases at the cutout reinforcement portion 160, and it is possible to enhance the strength of the core 126 for casting the turbine casing 26.

With this configuration, even if the turbine casing 26 is small, the turbine casing 26 can be produced readily by casting.

As depicted in FIGS. 15 and 16, in some embodiments, the cutout reinforcement portion 160 includes a downstream reinforcement portion 161 disposed on a section of a runner corresponding to the downstream cutout portion 61.

With this configuration, the thickness of the core 126 increases at the downstream reinforcement portion 161, and it is possible to enhance the strength of the core 126 for casting the turbine casing 26.

Specifically, the downstream reinforcement portion 161 between the first scroll forming portion 156 and the second scroll forming portion 158 is formed in a region corresponding to the downstream cutout portion 61. Accordingly, the first scroll forming portion 156 and the second scroll forming portion 158 merge in a region corresponding to the downstream cutout portion 61. As a result, the scroll forming portion 138 is reinforced in a region corresponding to the downstream cutout portion 61, and it is possible to enhance the strength of the joint section 157 between the first scroll forming portion 156 and the shroud forming portion 144 and the joint section 159 between the second scroll forming portion 158 and the shroud forming portion. As a result, the strength of the scroll forming portion 138 can be enhanced as a whole, and thus it is possible to enhance the strength of the core 126 for casting the turbine casing 26.

As depicted in FIG. 17, in some embodiments, the reinforcement portion 182 includes at least one narrow-space filling portion 183 disposed in a narrow space on an inner peripheral side of the partition-wall forming portion 154.

With this configuration, the thickness of the core 126 increases at the narrow-space filling portion 183, and it is possible to enhance the strength of the core 126 for casting the turbine casing 26.

Furthermore, the core 126 for casting the turbine casing 26 depicted in FIG. 5 includes narrow-space filling portions 183 in a narrow space corresponding to the upstream cutout portion 63 and a narrow space corresponding to the downstream cutout portion 64. Specifically, the narrow-space filling portions 183 are disposed in narrow spaces between the first scroll forming portion 156 and the second scroll forming portion 158 in a region corresponding to the upstream cutout portion 63 and a region corresponding to the downstream cutout portion 64. Accordingly, the first scroll forming portion 156 and the second scroll forming portion 158 merge in a region corresponding to the upstream cutout portion 63 and in a region corresponding to the downstream cutout portion 64.

As a result, the scroll forming portion 138 is reinforced in a region corresponding to the upstream cutout portion 63 and a region corresponding to the downstream cutout portion 64, and thereby it is possible to enhance the strength of the joint section 157 between the first scroll forming portion 156 and the shroud forming portion 144 and the joint section 159 between the second scroll forming portion 158 and the shroud forming portion 144 in two regions corresponding to the upstream cutout portion 63 and the downstream cutout portion 64. As a result, the strength of the scroll forming portion 138 can be enhanced as a whole, and thus it is possible to enhance the strength of the core 126 for casting the turbine casing 26.

Furthermore, the core 126 for casting the turbine casing 26 depicted in FIG. 6 includes narrow-space filling portions 183 disposed in the narrow spaces between the first scroll forming portion 156 and the second scroll forming portion 158 in a region corresponding to the first cutout portion 65, a region corresponding to the second cutout portion 66, a region corresponding to the third cutout portion 67, and a region corresponding to the fourth cutout portion 68. Accordingly, the first scroll forming portion 156 and the second scroll forming portion 158 merge in the region corresponding to the first cutout portion 65, the region corresponding to the second cutout portion 66, the region corresponding to the third cutout portion 67, and the region corresponding to the fourth cutout portion 68.

As a result, the scroll forming portion 138 is reinforced with a good balance in the region corresponding to the first cutout portion 65, the region corresponding to the second cutout portion 66, the region corresponding to the third cutout portion 67, and the region corresponding to the fourth cutout portion 68, and it is possible to enhance the strength of the joint section 157 between the first scroll forming portion 156 and the shroud forming portion 144 and the joint section 159 between the second scroll forming portion 158 and the shroud forming portion 144 in the four regions corresponding to the first cutout portion 65, the second cutout portion 66, the third cutout portion 67, and the fourth cutout portion 68. As a result, the strength of the scroll forming portion 138 can be enhanced as a whole, and thus it is possible to enhance the strength of the core 126 for casting the turbine casing 26.

As depicted in FIG. 18, in some embodiments, the reinforcement portion 182 includes at least one column portion 169 disposed on a runner corresponding to the partition wall 54.

With this configuration, two regions (the first scroll forming portion 156 and the second scroll forming portion 158)

of the outer-peripheral-wall forming portion 146 divided by the partition-wall forming portion 154 are connected via the column portion 169. As a result, it is possible to enhance the strength of the core 126 for casting the turbine casing 26.

As depicted in FIG. 18, the core for casting the turbine casing 26 depicted in FIG. 7 includes at least one column portion 169 disposed on a runner corresponding to the partition wall 54. For instance, the column portions 169 are disposed in regions corresponding to through holes 69 formed on the partition wall 54. Accordingly, the first scroll forming portion 156 and the second scroll forming portion 158 are connected by the column portions 169 in regions corresponding to the through holes 70, 71, 72 formed on the partition wall 54.

As a result, the scroll forming portion 138 is reinforced in regions corresponding to the through holes 70, 71, 72 formed on the partition wall 54, and it is possible to enhance the strength of the joint section 157 between the first scroll forming portion 156 and the shroud forming portion 144 and the joint section 159 between the second scroll forming portion 158 and the shroud forming portion 144. As a result, the strength of the scroll forming portion 138 can be enhanced as a whole, and thus it is possible to enhance the strength of the core 126 for casting the turbine casing 26.

In an example of the core 126 for casting the turbine casing 26 depicted in FIG. 7, one column portion 169 is disposed in each of the position at least 0 and no more than 90 degrees, the position of at least 90 and no more than 180 degrees, and the position of at least 180 and no more than 270 degrees in the circumferential direction of the shroud forming portion 144. Specifically, the column portion 169 is disposed in each of the positions of 45 degrees, 135 degrees, and 225 degrees, respectively. Furthermore, the column portions 169 become small in stages along the flow direction of the fluid, and in the example of FIG. 8, the column portions 169 are disposed in the descending order of size as follows: the column portion 169 at the position of 45 degrees, the column portion 169 at the position of 135 degrees, and the column portion at the position of the 225 degrees.

Accordingly, the scroll forming portion 138 is reinforced with a good balance at the positions of 45 degrees, 135 degrees, and 225 degrees, and it is possible to enhance the strength of the joint section 157 between the first scroll forming portion 156 and the shroud forming portion 144 and the joint section 159 between the second scroll forming portion 158 and the shroud forming portion 144 at the three positions of 45 degrees, 135 degrees, and 225 degrees. As a result, the strength of the scroll forming portion 138 can be enhanced as a whole, and thus it is possible to enhance the strength of the core 126 for casting the turbine casing 26.

Furthermore, as depicted in FIG. 19, in some embodiments, the reinforcement portion 182 includes at least one thick portion 176 that displaces the inner peripheral side of the partition wall in the axial direction of the shroud 44.

With this configuration, the thickness of the core increases at the thick portion 176, and it is possible to enhance the strength of the core 126 for casting the turbine casing 26.

Furthermore, in some embodiments, the at least one thick portion 176 includes first thick portions (not depicted) forming the first bend portions 77, 78 and second thick portions 179 forming the second bend portions 79, 80.

The core 126 for casting the turbine casing 26 depicted in FIGS. 8 and 9 includes the first thick portions (not depicted) and the second thick portions 179 disposed alternately at positions that divide the shroud forming portion 14 evenly into four sections in the radial direction. Accordingly, the first thick portions and the second thick portions 179 are disposed in pairs in the circumferential direction of the shroud forming portion 144. Specifically, in the circumferential direction of the shroud forming portion 144, the first thick portions are disposed centered at the positions of 180 degrees and 360 degrees, and the second thick portions 179 are disposed centered at the positions of 90 degrees and 270 degrees. Accordingly, the first scroll forming portion 156 is reinforced by the first thick portion, and the second scroll forming portion 158 is reinforced by the second thick portion 179. As a result, it is possible to enhance the strength of the joint section 157 between the first scroll forming portion 156 and the shroud forming portion 144 with the first thick portions, and the strength of the joint section 159 between the second scroll forming portion 158 and the shroud forming portion 144 with the second thick portions 179.

Furthermore, at the first thick portions of the core 126 for casting the turbine casing 26 depicted in FIG. 8, the joint section 157 between the first scroll forming portion 156 and the shroud forming portion 144 has an increased thickness, while the joint section 159 between the second scroll forming portion 158 and the shroud forming portion 144 has a reduced thickness, in the circumferential direction of the shroud forming portion 144. Furthermore, at the second thick portions 179, the joint section 157 between the first scroll forming portion 156 and the shroud forming portion 144 has an increased thickness, while the joint section 159 of the second scroll forming portion 158 has a reduced thickness. Accordingly, the first scroll forming portion 156 and the second scroll forming portion 158 have their strength enhanced and reduced in different sections in the circumferential direction of the shroud forming portion 144. However, the strength of the scroll forming portion 138 can be enhanced as a whole, and thus it is possible to enhance the strength of the core 126 for casting the turbine casing 26.

Furthermore, at the first thick portions of the core 126 for casting the turbine casing 26 depicted in FIG. 9, the joint section 157 between the first scroll forming portion 156 and the shroud forming portion 144 has an increased thickness, while the joint section 159 between the second scroll forming portion 158 and the shroud forming portion 144 has a break, in the circumferential direction of the shroud forming portion. Furthermore, at the second thick portions 179, the joint section 157 of the second scroll forming portion 158 has an increased thickness, while the joint section 159 between the first scroll forming portion 156 and the shroud forming portion 144 has a break. However, the strength of the scroll forming portion 138 can be enhanced as a whole, and thus it is possible to enhance the strength of the core for casting the turbine casing 26.

Furthermore, similarly to the core 126 for casting the turbine casing 26 depicted in FIG. 11, at the first thick portions of the core 126 for casting the turbine casing 26 depicted in FIG. 10, the joint section 157 between the first scroll forming portion 156 and the shroud forming portion 144 has an increased thickness, while the joint section 159 between the second scroll forming portion 158 and the shroud forming portion 144 has a break, in the circumferential direction of the shroud forming portion 144. Furthermore, at the second thick portions, the joint section 159 between the second scroll forming portion 158 and the shroud forming portion 144 has an increased thickness, and the joint section 157 of the first scroll forming portion 156 has a break. However, the strength of the scroll forming portion 138 can be enhanced as a whole, and thus it is possible to enhance the strength of the core for casting the turbine casing 26.

A method of manufacturing the turbine casing 26 according to some embodiments includes a step of providing the core 126 for casting the turbine casing 26, and a step of casting the turbine casing 26 with the provided core 126.

With these steps, even if the turbine casing 26 is small, the turbine casing 26 can be produced readily by casting. Thus, it is possible to provide a downsized turbine at low cost and with high productivity.

Further, in some embodiments, the method includes a step of placing a main mold for casting the turbine casing 26, a step of placing the above described core 126 in the main mold, and a step of pouring molten metal into a casting mold to cast the turbine casing 26.

With these steps, even if the turbine casing 26 is small, the turbine casing 26 can be produced readily by casting. Thus, it is possible to provide a downsized turbine at low cost and with high productivity.

Embodiments of the present invention have been described in detail above, but the present invention is not limited thereto, and various amendments and modifications may be implemented. Possible combinations of embodiments are disclosed by original claims as filed of the present application, or also by combination of original claims as filed of the parent application if the present application has a priority claim.

DESCRIPTION OF REFERENCE NUMERAL

10 Turbine
12 Compressor
14 Turbine housing
16 Turbine rotor
17 Operational flow path
18 Compressor housing
20 Impeller
22 Bearing housing
24 Drive shaft
26 Turbine casing
28 End wall
30 Bearing
32 Compressor casing
34 End wall
36 Cylindrical section
38 Scroll section
42 Intake section
44 Shroud
46 Outer peripheral wall (Scroll outer peripheral wall)
48 Tongue section
50 Wall
52 Circle
54 Partition wall
56 First scroll flow path
57 Throat portion
58 Second scroll flow path
59 Throat portion
60 Cutout portion
61, 62 Downstream cutout portion
63 Upstream cutout portion
64 Downstream cutout portion
65 First cutout portion
66 Second cutout portion
67 Third cutout portion
68 Fourth cutout portion
69, 70, 71, 72 Through hole
73 Rectifying portion
74 Thickness-increasing portion
75 Thickness-decreasing portion
76 Bend portion
77, 78 First bend portion
79, 80 Second bend portion
81 Boundary portion
126 Core
136 Cylinder forming portion
138 Scroll forming portion
144 Shroud forming portion
146 Outer-peripheral wall forming portion (Scroll-outer-peripheral-wall forming portion)
154 Partition-wall forming portion
156 First scroll forming portion
157 Joint section
158 Second scroll forming portion
159 Joint section
160 Cutout reinforcement portion
161 Downstream reinforcement portion
169 Column portion
176 Thick portion
179 Second thick portion
182 Reinforcement portion
183 Narrow-space filling portion
A, A1, A2 Flow-path area
C1, C2 Flow-path center
R, R1, R2 Distance from axis of shroud

The invention claimed is:

1. A turbine casing, comprising:

a shroud of a cylindrical shape defining an operational flow path between the shroud and a hub of a turbine rotor;

a scroll outer peripheral wall continuing from an end side of the shroud and extending along a circumferential direction of the shroud; and a partition wall disposed inside the scroll outer peripheral wall and dividing an inside of the scroll outer peripheral wall into a first scroll flow path and a second scroll flow path disposed adjacent to each other in an axial direction of the shroud, wherein the shroud, the scroll outer peripheral wall, and the partition wall are formed integrally by casting, wherein the partition wall, from a root end to a far end, is formed of molten metal poured into a runner formed between a main mold and a core, wherein the partition wall has a widening section which partially increases a communication area between at least two of the first scroll flow path, the second scroll flow path, and the operational flow path, in the circumferential direction of the shroud, wherein the widening section includes at least one cutout portion provided for an inner peripheral side of the partition wall, and wherein the at least one cutout portion includes a plurality of cutout portions disposed rotationally symmetric with respect to an axis of the shroud.

2. A turbine casing, comprising:

a shroud of a cylindrical shape defining an operational flow path between the shroud and a hub of a turbine rotor;

a scroll outer peripheral wall continuing from an end side of the shroud and extending along a circumferential direction of the shroud; and a partition wall disposed inside the scroll outer peripheral wall and dividing an inside of the scroll outer peripheral wall into a first scroll flow path and a second scroll flow path disposed adjacent to each other in an axial direction of the shroud, wherein the shroud, the scroll outer peripheral wall, and the partition wall are formed integrally by casting, wherein the partition wall, from a root end to a far end, is formed of molten metal poured into a runner formed between a main mold and a core, wherein the partition wall has a widening section which partially increases a communication area between at least two of the first scroll flow path, the second scroll flow path, and the operational flow path, in the circumferential direction of the shroud, and wherein the partition wall includes a rectifying portion disposed around the at least one through hole.

3. A turbine casing, comprising:

a shroud of a cylindrical shape defining an operational flow path between the shroud and a hub of a turbine rotor;

a scroll outer peripheral wall continuing from an end side of the shroud and extending along a circumferential direction of the shroud; and a partition wall disposes inside the scroll outer peripheral wall and dividing an inside of the scroll outer peripheral wall into a first scroll flow path and a second scroll flow path disposed adjacent to each other in an axial direction of the shroud, wherein the shroud, the scroll outer peripheral wall, and the partition wall are formed integrally by casting, wherein the partition wall, from a root end to a far end, is formed of molten metal poured into a runner formed between a main mold and a core, wherein the partition wall has a widening section which partially increases a communication area between at least two of the first scroll flow path, the second scroll flow path, and the operational flow path, in the circumferential direction of the shroud, wherein the widening section includes at least one bend portion provided for an inner peripheral side of the partition wall, and wherein the at least one bend portion includes:

at least one first bend portion widening a throat portion of the first scroll flow path facing the operational flow path; and at least one second bend portion widening a throat portion of the second scroll flow path facing the operational flow path.

4. A turbine comprising the turbine casing according to claim 1.

5. A turbine comprising the turbine casing according to claim 2.

6. A turbine comprising the turbine casing according to claim 3.

* * * * *